US006223577B1

(12) United States Patent
Ujc et al.

(10) Patent No.: US 6,223,577 B1
(45) Date of Patent: May 1, 2001

(54) AUTOMATED PROFILE CONTROL—ROLL FORMING

(75) Inventors: Harold Ujc, Toronto; Waldemar H. Greiner, Waterdown, both of (CA)

(73) Assignee: Panelmaster International, Inc., Nassau (BS)

( * ) Notice: Subject to any disclaimer, the term of this patent is extended or adjusted under 35 U.S.C. 154(b) by 0 days.

(21) Appl. No.: 09/433,572

(22) Filed: Nov. 4, 1999

(51) Int. Cl.[7] ..... B21D 5/08
(52) U.S. Cl. ..... 72/181
(58) Field of Search ..... 72/181, 180, 182, 72/176

(56) References Cited

U.S. PATENT DOCUMENTS

| | | | | |
|---|---|---|---|---|
| 1,435,835 | * | 11/1922 | Gale | 72/181 |
| 1,673,787 | * | 6/1928 | Frahm | 72/181 |
| 3,845,646 | | 11/1974 | Bellmann | 72/100 |
| 4,064,727 | | 12/1977 | Amano | 72/179 |
| 4,392,369 | | 7/1983 | Ramdohr | 72/96 |
| 4,716,754 | | 1/1988 | Youngs | 72/181 |
| 4,939,919 | | 7/1990 | Chezzi | 72/181 |
| 5,319,952 | | 6/1994 | Cadney | 72/181 |
| 5,829,294 | * | 11/1998 | Bradbury | 72/181 |
| 5,855,133 | | 1/1999 | Hayes | 72/181 |
| 5,970,764 | * | 10/1999 | Surina | 72/181 |

FOREIGN PATENT DOCUMENTS

| | | | | |
|---|---|---|---|---|
| 2154816 | | 1/1997 | (CA) . | |
| 2176281 | | 1/1999 | (CA) . | |
| 3-424 | * | 1/1991 | (JP) | 72/181 |
| 689757 | * | 10/1979 | (RU) | 72/181 |

* cited by examiner

*Primary Examiner*—Daniel C. Crane
(74) *Attorney, Agent, or Firm*—Bereskin & Parr

(57) ABSTRACT

A roll forming machine comprises a plurality of stations for progressively bending a flat strip of material such as metal into a formed product such as a building stud. The machine includes adjusting means for adjusting the spacing between the roll forming dies to accommodate differing thicknesses of metallic strip. Each station is adjusted along an angle of adjustment which is related to the bend angle at that station. A single adjustment actuator adjusts all of the stations even though each station is being adjusted at a different angle. In a preferred embodiment, the amount of adjustment at each station may be different from other stations being adjusted to provide adjustment not only in the correct direction but also in the correct amount.

19 Claims, 20 Drawing Sheets

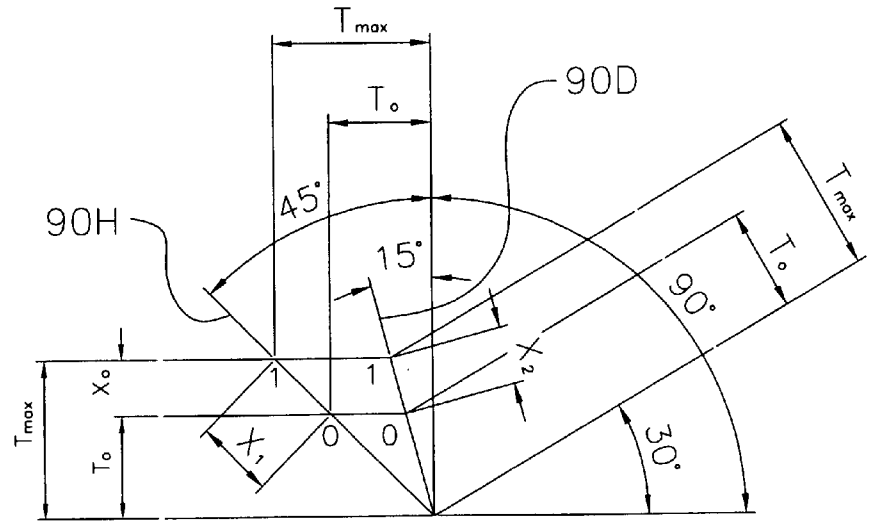

FIG. 14

$T_o$ = MINIMUM MATERIAL THICKNESS
$T_{max}$ = MAXIMUM MATERIAL THICKNESS
P = POINT OF ORIGIN
0 = POINT FOR AUTOMATIC MOTION SETTING
1 = POINT FOR MAXIMUM TRAVEL $X_1 = 1.4142X_o$ FOR 90° BEND
$X_2 = 1.0353X_o$ FOR 30° BEND
$X_1 - X_2 = 0.3789X_o$ FOR BEND BETWEEN 30° AND 90°
$X_1 - X_2 = 0.010$ MAX. ALLOWED $X_o = \frac{0.010}{0.3789} = 0.0264''$ MAX. ALLOWED VARIATION IN MATERIAL THICKNESS WITHOUT INTRODUCING THREAD CHANGE ON ADJUSTING SCREW. THIS APPLIES TO A BENDING RANGE FROM 0° TO 90°.

VARIATION IN MATERIAL THICKNESS
WITHOUT THE THREAD CORRECTION:
GAUGE: 10 TO 12 POINT FOR AUTOMATIC MOTION SET FOR GAUGE 12 (0.109–0.141)
GAUGE: 13 TO 16 POINT FOR AUTOMATIC MOTION SET FOR GAUGE 16 (0.062–0.094)
GAUGE: 17 TO 24 POINT FOR AUTOMATIC MOTION SET FOR GAUGE 24 (0.025–0.056)

AUTOMATED PROFILE CONTROL— ROLL FORMING

FIELD OF THE INVENTION

This invention relates to machines and processes for roll forming. In particular, the invention relates to means to adjust a roll forming machine to accommodate differing thicknesses of metal to be worked.

Roll forming is the term used to describe the working of a sheet of metal to transform the metal into a desired shape. In order to form the metal from a substantially planar condition, the metal is passed through dies. The dies comprise a pair of cooperating rollers that revolve as the material is drawn between the rollers and which cause bending of the sheet into a desired configuration. Typically, roll forming involves a plurality of stations and the transformation from the substantially planar condition of the metal at the feed end to the configuration at the completed end takes place in a series of progressive steps.

Many products are conventionally and commercially made through roll forming processes. Many metals are used in roll forming. Examples are items such as eavestroughing which may be formed from aluminum or copper and roofing panels which may be formed from coated steel. Typically, roll forming is often the desired method for forming products which have a uniform cross-sectional configuration along their length and which may have indefinite or extended length.

One of the products that may be made in roll forming conditions and using, typically, steel, is the array of metallic building products. Such building products may include U-shaped structures which may be used as upper and lower tracks in wall structures and studs which may have differing configurations such as U-shaped, C-shaped, etc. As metallic structures do not warp or twist when drying, such building components are now replacing wood for many applications. The metallic members are used in a variety of applications. A track replaces a wooden header or footer. The track is generally a U-shaped configuration which may be attached to an existing floor or to an existing ceiling structure or may be freestanding. The studs have any of a variety of configurations and are usually located within the upper and lower track to comprise a wall structure. In addition, truss-like components may be made involving a series of members including chords, beams and the like. Where a wall may have an opening for a door or window or similar opening, additional framing members are required at the location of the opening to define the opening and to support the opening within the wall structure. Such studs are conveniently made in a roll forming operation.

The initial utility of metal formed products, in addition to the freedom of many of the problems associated with wood, is the speed with which the walls may be erected. Such structures have found particular acceptance commercially in the building industry where the walls are of the type defined as non-load bearing. Such walls often support drywall or other similar types of cladding material, but do not themselves carry the structural support function of the building. One of the reasons why steel studding has enjoyed greater success in non-load bearing applications as compared to load bearing applications, is that when load bearing applications are desired, the fit of the studs, chords or other load bearing members in the supporting structure such as tracks becomes more critical. Such studs are commonly affixed to the track by means of a fastener such as a screw. It is not desirable that the screw form part of the structural support path but merely fix the location of the stud in track. In a non-load bearing structure, the fit of the stud into the track may not be as critical, while in load bearing situations this becomes much more important.

Typically, in roll forming equipment today, some means is provided for supporting a coil of feed material. The coils of feed material may be of extended length in the order of several hundreds of feet. The material within the coil is of a desired gauge or thickness and of the desired width for making the desired component. The coil of material is positioned adjacent the feed end of the roll forming machine. An apparatus of some kind is included to support the coil in position and to turn the coil so as to feed the material from the coil to the roll forming machine. As the metal passes along the roll forming machine, the metal passes through a plurality of stations and is progressively formed into the desired end configuration. As the product emerges from the roll forming stage, additional dies may be used to notch the product as required and some type of flying die is normally involved to cut the product into the desired lengths. The present roll forming machines all work adequately in this application and produce a uniform product whose overall length but for the severing into discrete pieces is substantially equal to the length of the material wound on the coil.

When it is desired to feed material of a different thickness or width through the roll forming machine, each of the plurality of die sets must be adjusted for the new material. Typically, this involves making adjustments by hand to adjust the space between the roller dies to accommodate the material of differing thickness. As, typically, in the formation of products such as steel studs and the like, both edges of the strip of material are formed, then there will be sets of dies down both the left and right sides of the roll forming machine. As a typical roll forming machine may involve as many as 18 stations, this means that 36 different stations must be adjusted by hand for the new material. This takes substantial set up time, which in turn dictates that changes in set up are minimized as much as possible.

This, in turn means, that once the standard roll forming machine is set up, typically the machine continues to produce the product for which it has been adjusted until the coil of material is exhausted. If a building component having a different thickness is required, then the machine is shut down for what may well be several hours, adjusted for the new material, and then product is produced from the new material. Once set up for the new material, the product of that size and gauge is produced until that coil is exhausted. When the second coil is exhausted, either another coil of the same thickness is fed into the machine or the machine is once again shut down for several hours and readjusted for the first or a third gauge of material.

The gauge of material for building components may vary considerably depending upon the use of the component. Non-load bearing studs need not be of as heavy gauge or thickness as load bearing materials. Similarly, within a given wall structure, whether load bearing or not, differing gauge materials may be used to make the track as opposed to that required for the studs. Similarly, certain of the building components such as headers or framing for openings and the like, may be of different gauge than adjacent framing members. In addition, where openings are large, that is covering more than the typical spacing for such framing components, which in North America is typically 16 inches on centre, then heavier gauge components may be required in some sections of a wall but not in others. Another problem of the existing machines is that because of the lengthy down time between set ups, typically a full coil length worth of product is produced which must then be inventoried. This is followed by producing a full coil length of a different material which requires a second inventory storage space. When two materials are intermixed such as tracks and studs of different thickness, this means the roll formed products must then be selected from at least two different inventory storage locations.

One example of an attempt to handle this issue is illustrated in U.S. Pat. No. 5,855,133, Hayes, issued Jan. 5, 1999. In the Hayes structure one of the forming rolls of a set of roller dies is mounted on an eccentric so that one roller can move relative to the other and so increase the spacing to accommodate thicker material. An eccentric motion however, allows longitudinal motion as well as vertical motion and thus, the orientation of the set of roller dies changes. In addition, in that device, all movement of the upper roller die is in the vertical and longitudinal directions, no attempt is made to adjust the roller die in the lateral direction in accordance with the bend angle $\alpha$ of the particular roller die being adjusted. While this approximation of required movement is acceptable for some end products, it is not acceptable for others.

A similar approach is used in Canadian Patent Application No. 2,154,816 laid open Jan. 28, 1997, Surina. Surina also uses an eccentric member to move one of the pair of roller dies to provide vertical adjustability for a different thickness material. The eccentric also contributes a longitudinal displacement of the roller die which is not desirable. To achieve lateral displacement of one roller die with respect to the other roller die of a set, Surina moves the shaft laterally. Surina shows use of a rack and pinion to move all eccentrics the same amount and another rack and pinion to move all roller dies laterally the same amount. While this provides adjustability transversely and vertically, the system also introduces longitudinal movement which is not desirable and the same adjustment in amount and direction occurs at each set of roller dies. As the bend angle $\alpha$ of each roller die set is different, this system is not as accurate as desirable.

Accordingly, there is a need for a machine having sets of roller dies which may be relatively easily adjusted to account for differing thicknesses of feedstock material wherein the movement of adjustment occurs in a direction which is appropriate in each station for angle $\alpha$ of the roller die set at the station.

In accordance with the invention, a roll forming machine comprises a plurality of stations for forming a flat metal strip into a product, each of the stations having a roller die set comprising a first roller die and a second roller die, the roller die set defining an angle $\alpha$ for bending the metal strip, each of the stations having a different angle $\alpha$, and including thickness adjustment means for moving one of the roller dies of the roller die set relative to the other of the roller dies in a direction of travel which is directly related to the bend angle, a for adjusting the station to be able to form products from different thicknesses of metal strip, and wherein there is a common operating means for operating the adjustment means of each of the stations simultaneously.

In a further preferred embodiment, the invention comprises a roll forming machine as outlined above, and where, in addition, each station is additionally adjustable so that the direction of travel or thickness adjustment can be adjusted so as to be directly related to the bend angle $\alpha$. This enables individual stations to be readjusted if a different set of roller dies having a different bend angle $\alpha$ are used at that station and also facilitates a common design for the stations which may be used with different sets of roller dies. In this preferred embodiment, levelling means are included for adjusting location of one of the roller dies relative to the other of the roller dies of the set so that the taps on which the roller dies are mounted can be adjusted to be parallel after adjustment to achieve the correct direction of travel for thickness adjustments.

The invention will be more clearly understood from reference to the attached drawings which illustrate a preferred embodiment of the invention and in which:

FIG. 14 is a line diagram illustrating the amounts of movement and direction of movement required for roller die sets having $\alpha$ angles of 30° and 90°;

Figure 1:
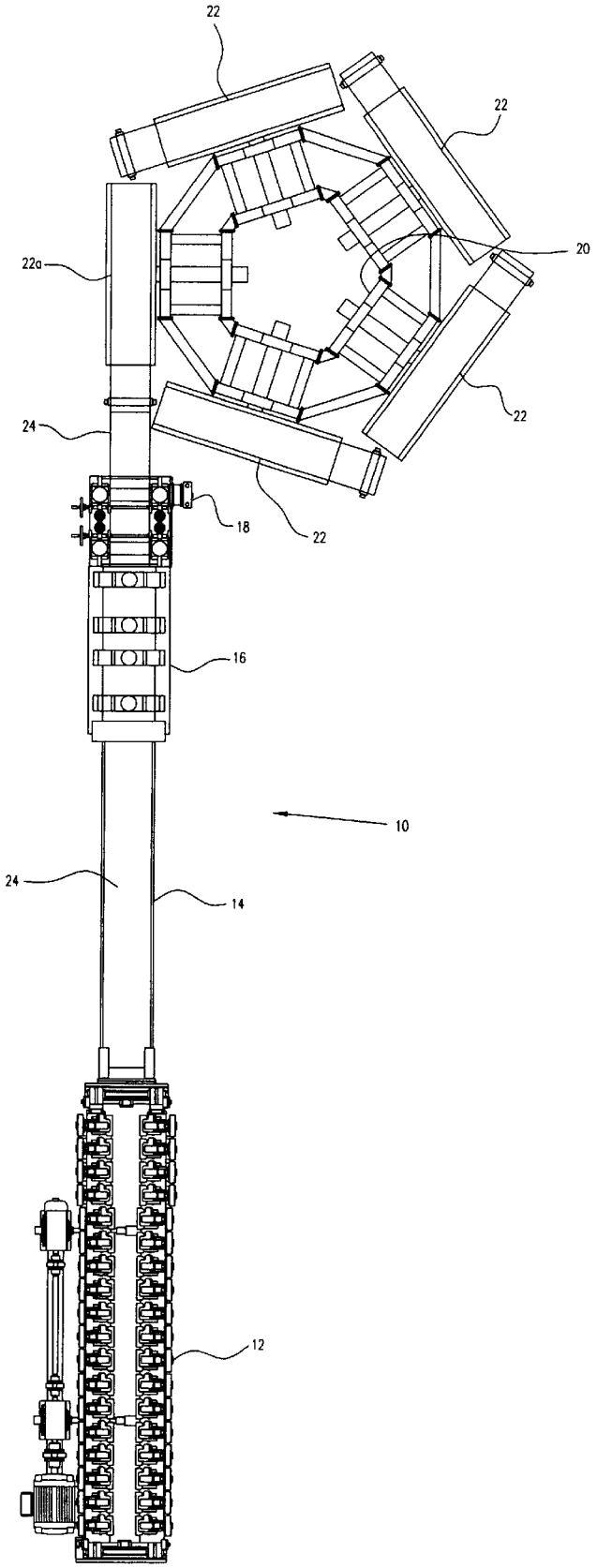
FIG. 1 is a plan view of an apparatus for storing and dispensing metal strips and apparatus for forming the metal strips into a product.

FIG. 1 illustrates an assembly of devices illustrated generally at 10. The assembly includes a roll forming machine 12, a precut table 14, a flattener 16 with roll feed, a drive unit 18 for the flattener and a turn table 20 for holding and supporting a plurality of coils 22. One such coil 22*a* is shown positioned to feed a strip of metal 24 for processing into a final shape.

Figure 2:
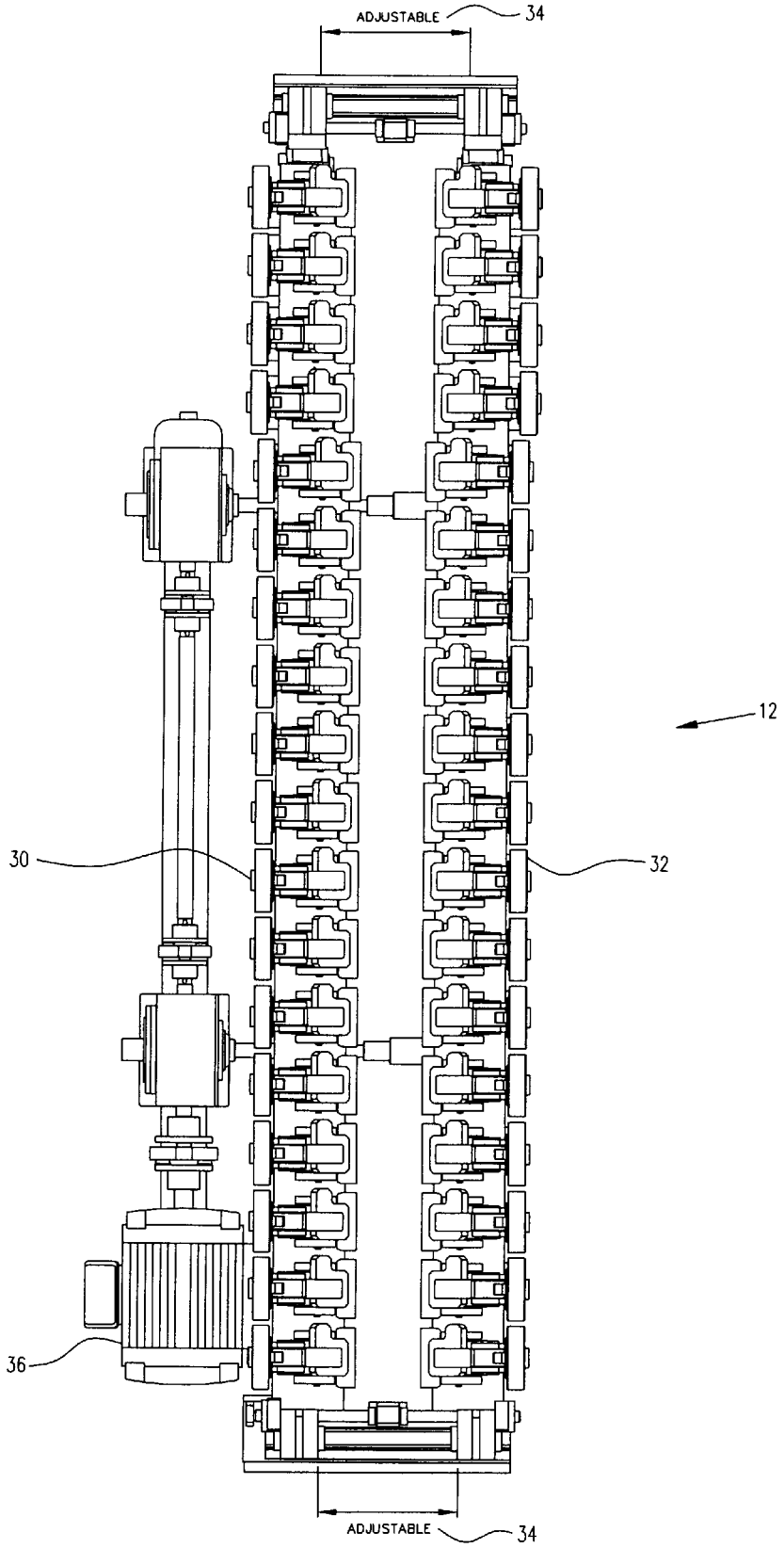
FIG. 2 is a plan view of a roll forming machine of FIG. 1.

FIG. 2 illustrates a roll forming machine 12 in a little more detail. The roll forming machine 12 when viewed from above comprises the left assembly of roll forming stations 30 and a right assembly of roll forming stations 32. As shown by the arrows 34, the lateral spacing between the assemblies 30 and 32 may be varied to accommodate strips of metal of different widths. The roll forming machine includes a drive motor 36 to provide drive to the roller dies through a typical transmission and gear set. Each of the left and right assemblies includes a plurality of stations for progressively shaping the metal to form the desired product. Each such station is comprised of a set of roller dies as shown in FIG. 3.

Figure 3:
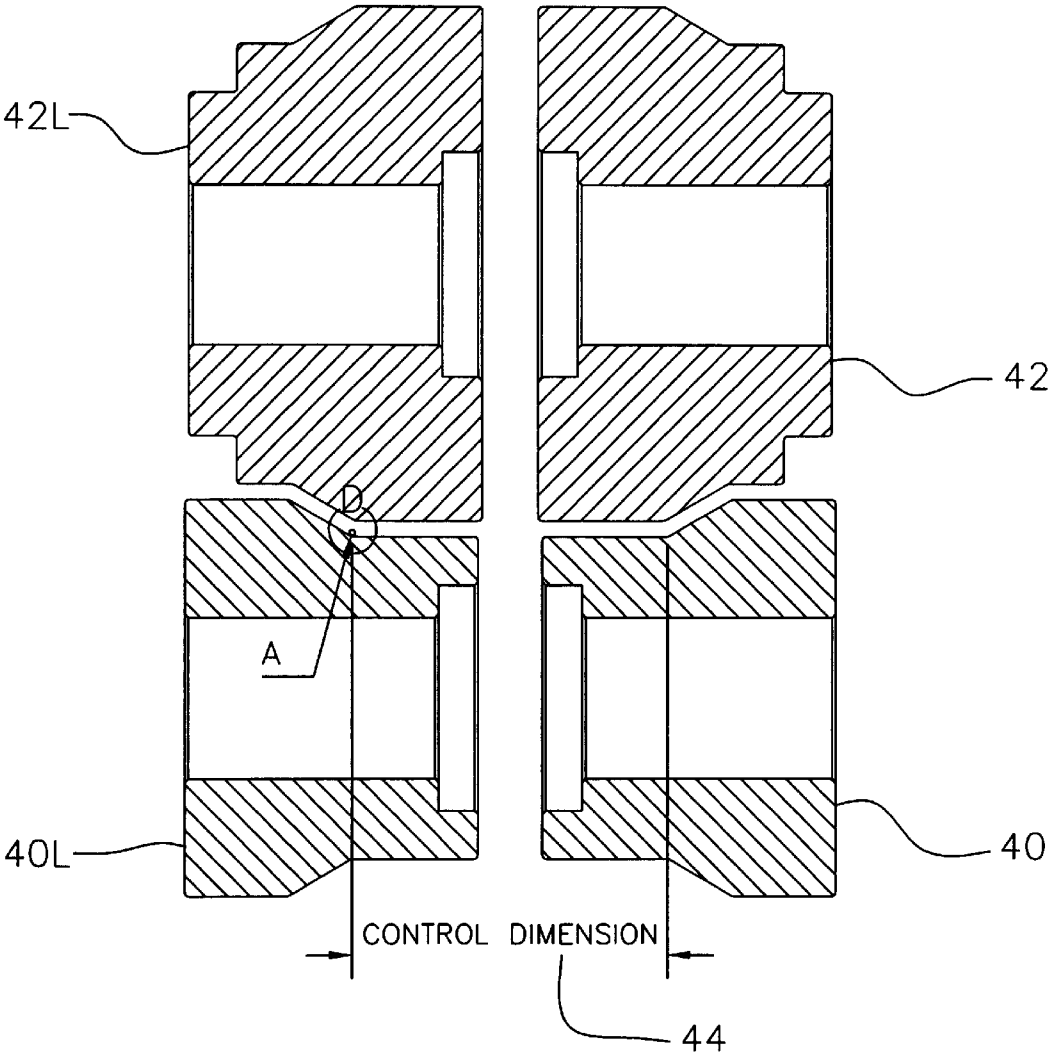
FIG. 3 is a vertical cross-section of left and right roller die sets which may be used in the roller forming machine of FIG. 2.

FIG. 3 illustrates a lower roller die 40 and its cooperating upper roller die 42. As shown in FIG. 3, the corresponding station in the left assembly 30 will include a lower roller die 40L and an upper roller die 42L. With reference in particular to FIG. 3, it will be noted that the roller dies are located so as to define therebetween a gap which gap is equal to the thickness of the material to be roll formed in the machine. The dimension illustrated as 44, is referred to as the control dimension. This is the lateral spacing between the perimeter points on the horizontal plane generated by the horizontal face of the roller dies 40 and 42. The control dimension as required of most studs or the like will have a fixed dimension for acceptance into tracks or other similar building components.

Figure 4:
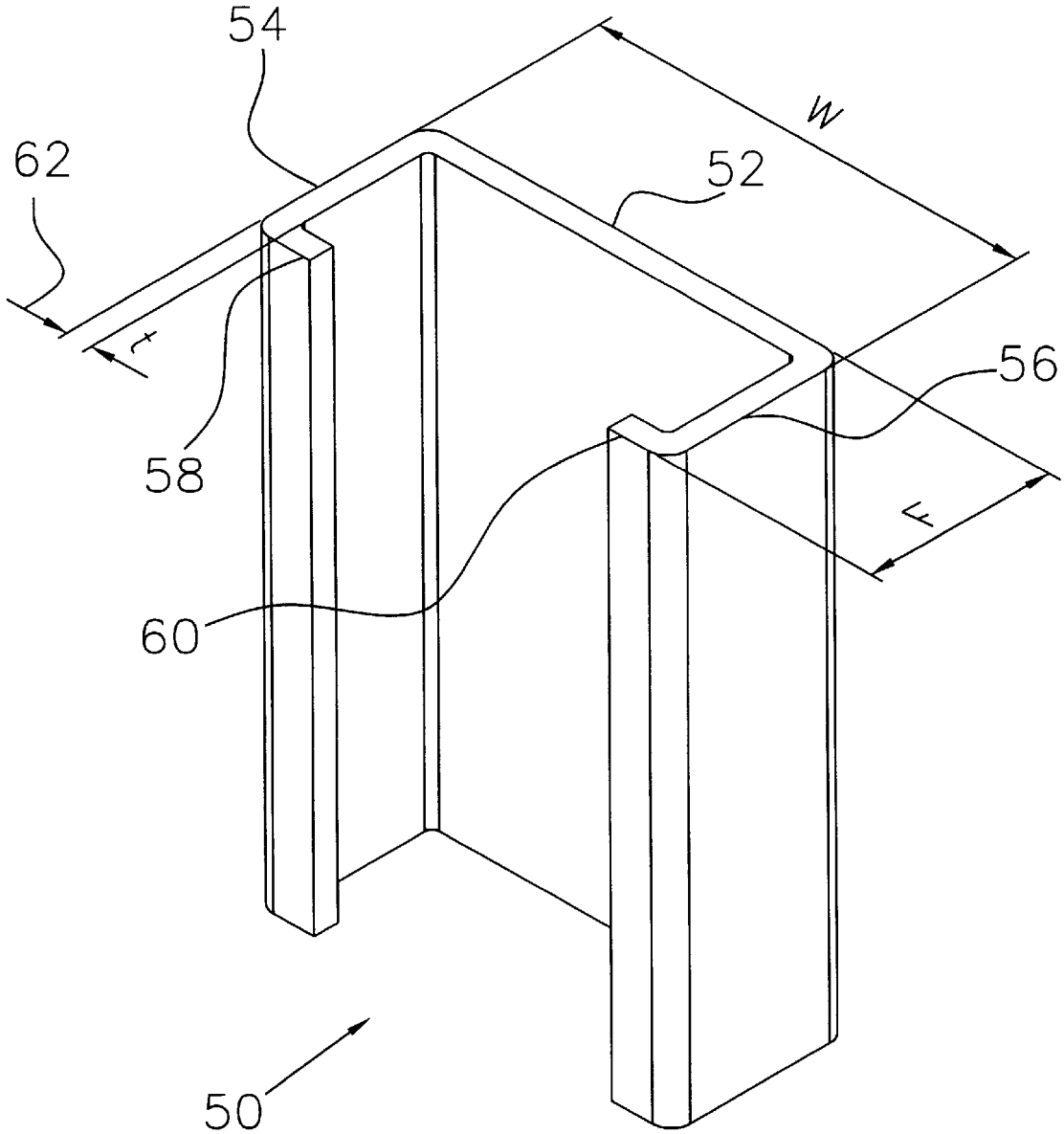
FIG. 4 illustrates a stud product to be formed in the machine of FIG. 2.

With reference to FIG. 4, a typical profile for a stud 50 is illustrated. The stud 50 comprises a web 52 which has an external width W. The stud has a pair of flanges 54 and 56 which have an overall height F. The stud 50 shown in FIG. 4 is often referred to as a C-shaped stud and includes a pair of returns 58 and 60. The thickness of the material is shown by the arrowhead 62. The dimension W is the control dimension of the stud.

Figure 5:
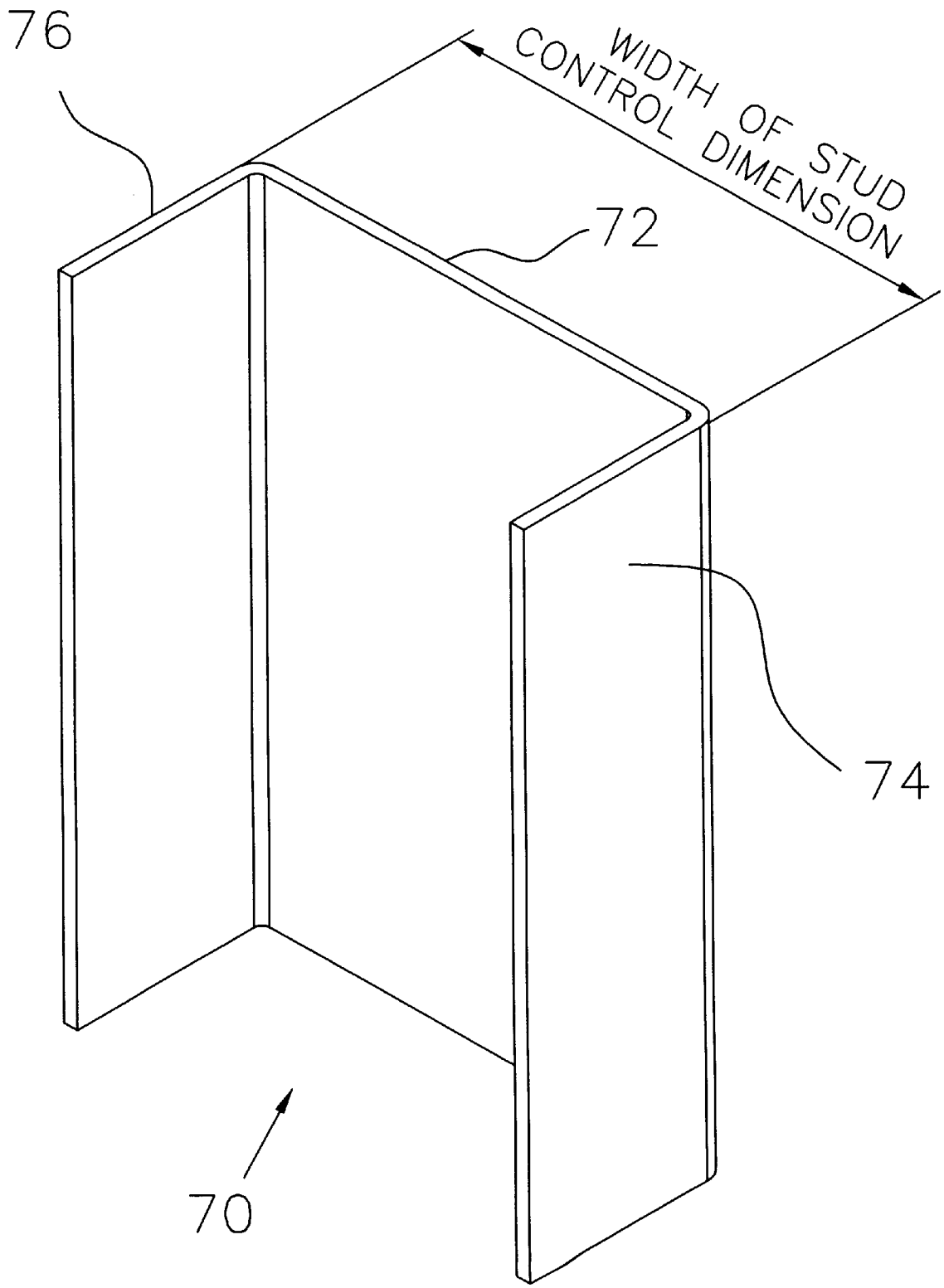
FIG. 5 illustrates an alternate product which may be formed in the machine of FIG. 2.
Figure 6:
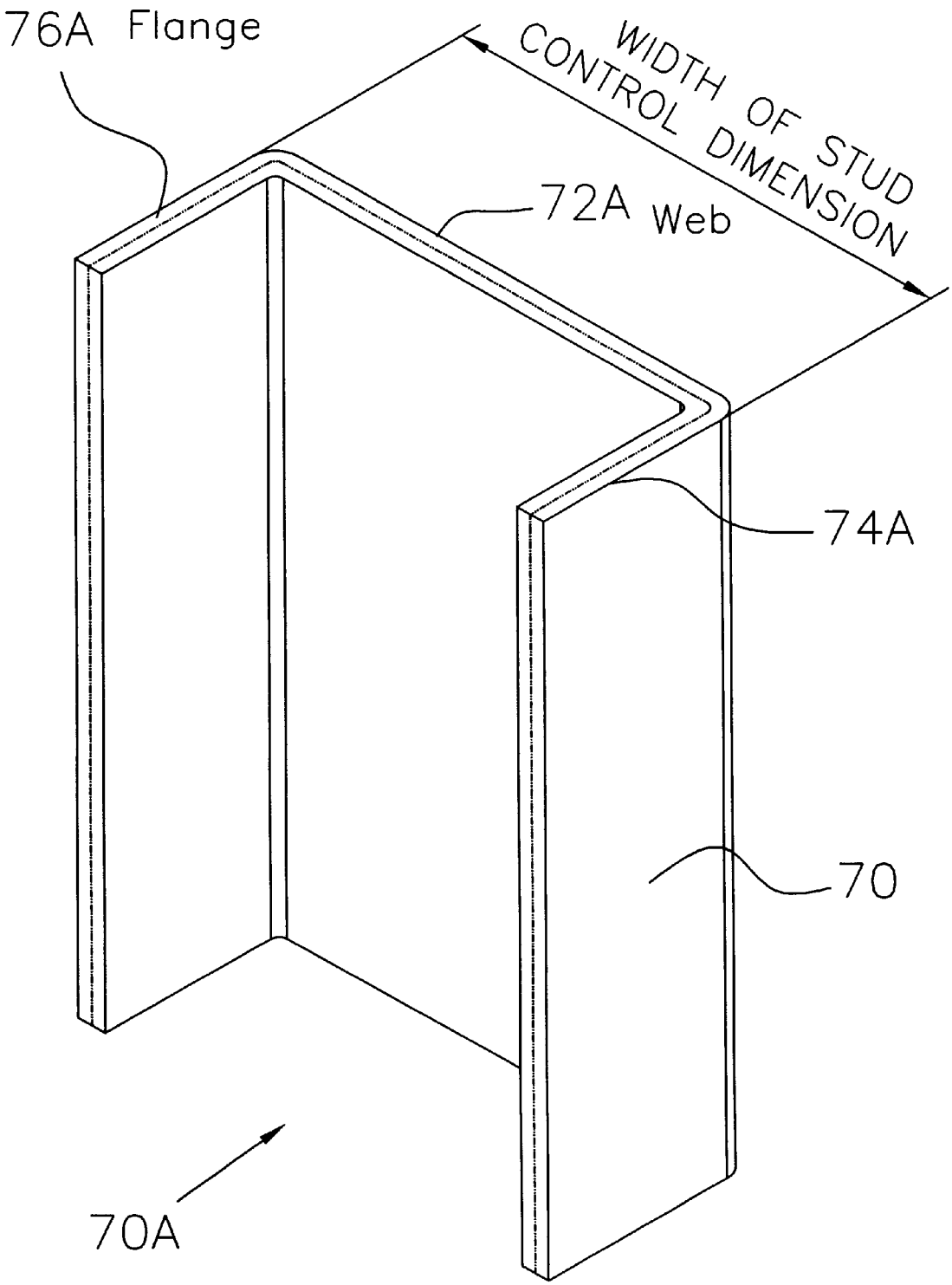
FIG. 6 illustrates a further alternate product which may be formed in the machine of FIG. 2.

In FIG. 5 there is shown a different stud 70. The stud 70 is not a C-shaped stud, but is rather a U-shaped stud having a web 72 and two flanges 74 and 76. The stud 70*a* illustrated in FIG. 6 similarly has a web 72*a* and two flanges 74*a* and 76*a*. The control dimension or width of the stud 70*a* is the same as the control dimension or width of stud 70. For illustration purposes, the thickness of the stud 70 is illustrated on the stud 70*a* so that it will be clear that the stud 70*a* is made from a material which is approximately twice the thickness of the material of the stud 70. Thus, the web 72*a* is twice as thick as the web 72 and the flanges 74*a* and 76*a* are twice as thick as the flanges 74 and 76. However, the outer width or control dimension of the two studs is identical. This in part means that the extra thickness of the material is accommodated within the U-shaped configuration formed by the flanges and the web rather than increasing the overall width of the stud.

Figure 7:
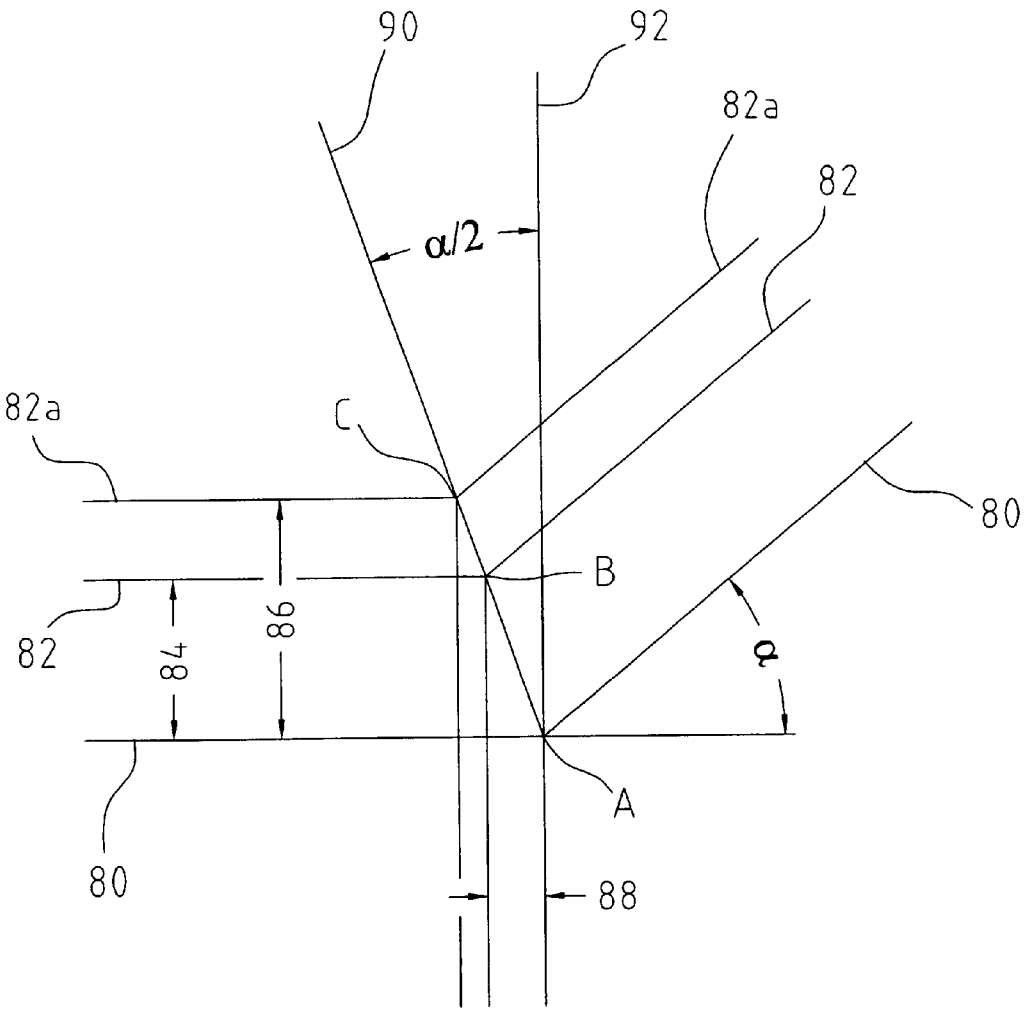
FIG. 7 is a line diagram illustrating the direction of travel when adjusting one of the roller sets of FIG. 3.

In order to more clearly appreciate the issues involved in adjusting a roll forming machine for varying thicknesses of material, reference may conveniently be had to FIG. 7. Line 80 represents the upper surface of lower roller die 40, while line 82 represents the lower surface of the upper roller die 42. The horizontal portion of the surface of the lower roller die 40 meets the angled portion at a point marked A. Similarly, the horizontal portion of the surface 82 meets the angled portion of the surface 82 at a point marked B. The distance 84 between these surfaces represents the thickness or gauge of the material to be worked in the roller dies 40, 42.

The control dimension is set by the point A. In order to ensure that the central dimension is the widest dimension of the product to be produced, the related point B of the upper roller die 42 is displaced in FIG. 7 to the left, a horizontal displacement distance marked by the arrow 88.

When a thicker material having a thickness as indicated by the arrow 86, is to be passed through the roller die, the distance between the rollers must be increased to accommodate the thickness. Assuming for the moment that the lower roller die 40 is fixed, then the upper roller die 42 must be moved upwardly to accommodate the thicker material where the roller dies have opposing horizontal surfaces and must be moved laterally to the left in FIG. 7 to accommodate the thicker material to the right of the points A and B. The line 90 illustrates the direction of travel of the upper roller 42 relative to the lower roller 40 that is necessary to accommodate the thicker material. The acute angle formed by the surface 80 at the point A, the bend angle, may be defined as $\alpha$. As the sheet progressively passes along the roll forming machine from station to station, the angle $\alpha$ will be increased in each station until in the final station or stations, the angle $\alpha$ will become 90°. Geometrically, it may be shown that the angle between the direction of travel 90 and the vertical line 92 is equal to $$\frac{\alpha}{2}.$$

When the upper roller die 42 is moved in the direction of travel given by line 90 to accommodate a thicker material having thickness defined by the arrows 86, the surfaces will be located in the positions identified by the lines 82*a*. In addition, the point B of upper roller die 42 will have been moved to the position indicated by the letter C. The distance the upper roller die 42 has been moved along the direction of travel 90 from point B to point C is greater than the vertical increase in thickness as given by the difference between the dimensions marked by arrows 86 and 84. The distance B–C is a function of the angle $\alpha$. It may be shown mathematically that the distance between B and C is a function of the cosine of $$\frac{\alpha}{2}.$$

Review of this figure indicates why there is such an extensive set up time in conventional roller forming machines. For a thickness increase, the direction of movement of the roller die is different for each station as $\alpha$ is different in each station. In addition, the amount of adjustment of the upper roller die in each station along the progression of stations is different and increases with each station as the angle $\alpha$ increases. This means that for each pair of stations in the left and right assembles of stations, the adjustments are equal but in opposite direction. In addition, each pair of stations along the array must be adjusted in a different direction and a different amount.

In the preferred embodiment discussed below, the adjustment of all stations in the left or right assemblies respectively can be accomplished by a single drive shaft which adjusts each station in a different direction.

From the foregoing analysis, it may also be seen that as the distance to be moved is a function of the cosine, then the distance to be moved will be greater, the greater the angle $\alpha$. Put another way, this means that if the thickness of the piece is increased by x, then the amount of movement in a first station where $\alpha$ may be 5° will be only slightly greater than x, while the amount of corresponding movement in station 18 where a may be 85° will be considerably greater than x.

Typically, roll forming machines are designed to have maximum and minimum thickness capabilities. If the variation between the thinnest material and the thickest material for which the machine is designed is small, then it may be acceptable to adjust all of the stations the same distance in magnitude with the structure of this invention. This is because with the machine of this invention, each station is being adjusted at the correct angle for that station and thus using a fixed distance may be adequate over small thickness changes. In particular, this may be made more acceptable if the distance to be moved is averaged over the stations. Thus, a station at approximately the midpoint of the work to be done should be adjusted the correct distance in the correct direction. Then stations which are downstream in the direction of sheet passage would be adjusted in the correct direction but the same amount and thus would be adjusted a little less than required, while stations up stream would be adjusted in the correct direction but in an amount a little greater than would be required. Whether or not such approximation would be acceptable will depend upon the range between the thickest and thinnest material for which the roll forming machine is designed, as well as the criticality of the components formed within the machine.

In the preferred embodiment of the machine as described below, structure is incorporated in the roll forming machine that permits a single powered shaft to adjust all stations in the correct direction and if desired in the precise magnitude for that station.

Figure 8:
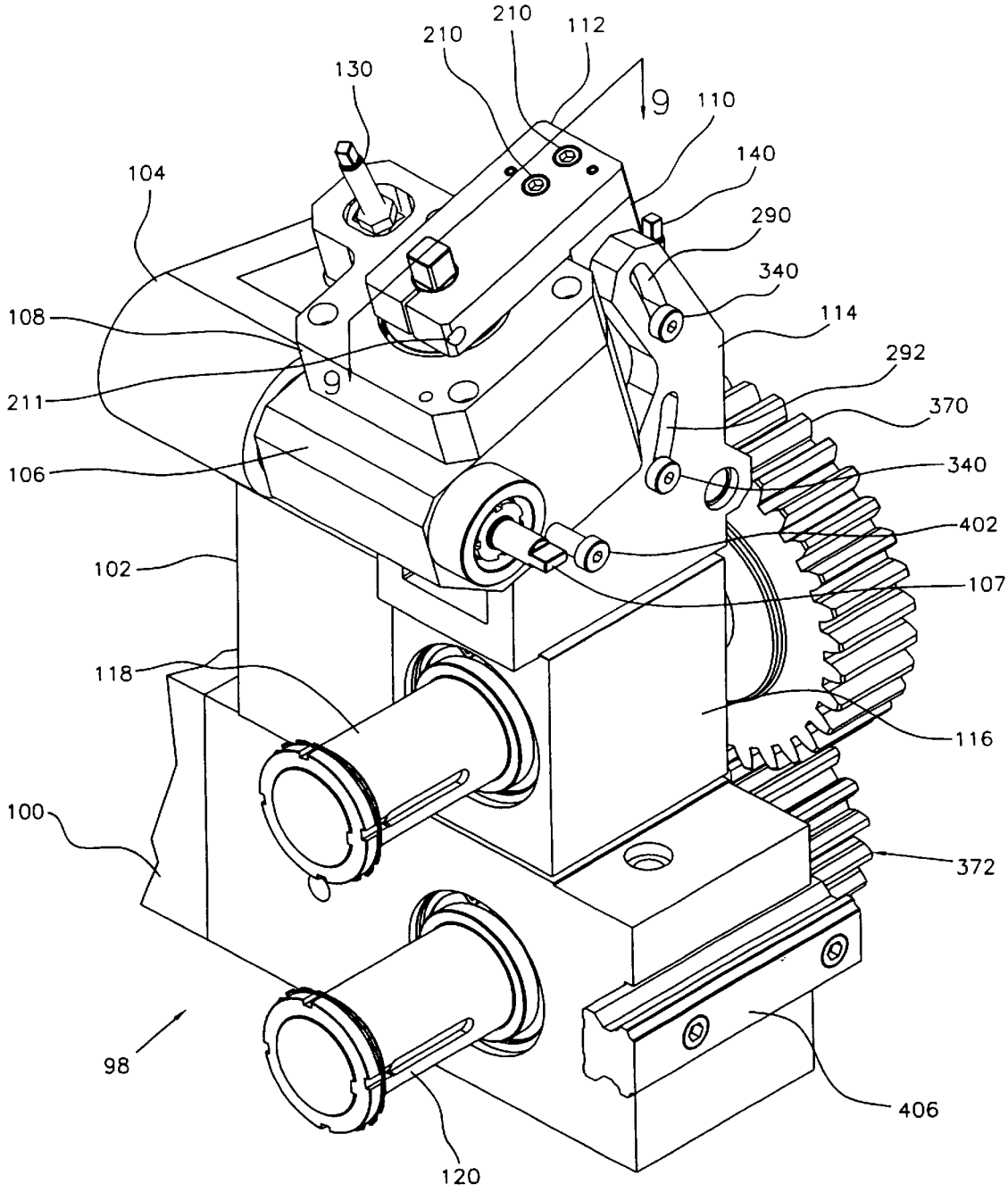
FIG. 8 illustrates one of the stations of the roller forming machine of FIG. 2.

FIG. 8 illustrates the first of the stations 98 taken from the right assembly of stations, 32. FIG. 8 is a perspective view and the roller dies have been removed from their shafts for purposes of clarity. The station 98 comprises several parts which will be explained more fully below. The station comprises a lower base block 100 which extends along the entire length of the right assembly 32. There is a separator block 102 which is permanently bolted to the lower base block 100. The station 98 also includes a pivot bracket 104 which is bolted to the separator block 102. The station 98 further comprises a gear housing 106 which is attached to the pivot bracket 104 for pivotal motion about a substantially horizontal drive shaft 107. The station 98 also includes a gear housing cover 108 which is bolted to the gear housing 106. The gear housing cover 108 provides a mounting means for an adjustment block 110. The station 98 also includes an adjustment block plate 112 which is bolted to the adjustment block 110 for movement with the adjustment block 110. The station 98 also includes a levelling block 114. The levelling block 114 is affixed to the adjustment block 110 for movement with the adjusting block 110. Finally, the station includes an upper bearing block 116 which is attached to the levelling block 114.

The upper bearing block 116 supports a first, in this case upper, roller die shaft 118. The lower base block 100 supports a second, in this case, lower roller die shaft 120.

In summary, the lower roller die shaft 120 remains in fixed position supported in the lower base block 100. The upper roller die shaft 118 is supported and located by upper bearing block 116. After initial set up, the station 98 can be adjusted for differing thicknesses of material as follows. The drive shaft 107 rotates. That rotation as will be more fully explained below causes movement in the direction of travel 90 along the line A, B, C (see FIG. 7) of the structure comprising the adjustment block 110, the adjustment block plate 112, the levelling block 114 and the upper bearing block 116. This moves the upper roller die shaft 118 in a direction having both vertical and transverse horizontal components so that the upper roller die shaft 118 is then located in the correct location for the thickness of the new sheet material.

The structure illustrated in station 98 may be used at any of the various stations in the right assembly 32. In each station, there will be a different angle α. Alternatively, if the roller dies are replaced with a different set of roller dies having a different angle α, then the structure 98 must be adjusted to provide movement of the adjustment block at the correct angle. The adjustment is achieved by rotating the α adjustment screw 130. Upon rotation of the α adjustment screw 130, the gear housing 106 will rotate about the drive shaft 107 to assume the correct angle α. When the gear housing 106 rotates about the drive shaft 107 to a new angle α, the adjustment block 110, the levelling block 114 and the upper bearing block 116 will also all rotate the same amount. Because the upper bearing block 116 will be rotating, then the axis of the upper roller die shaft 118 would no longer be parallel to the lower roller die shaft 120. In order to adjust the orientation of the upper roller die shaft 118 so that in the new angle α, a parallel condition is achieved, the parallel adjustment screw 140 is rotated. Movement of the parallel adjustment screw 140 causes movement of the levelling block 114 relative to the adjustment block 110. Movement of the levelling block 114 then moves the upper bearing block 116 to the desired location in which the upper roller die shaft 118 is parallel to lower roller die shaft 120. During such parallel adjustment, the adjustment block 110 does not move so that it remains in the correct orientation for the angle α.

A more detailed explanation of the operation of the parts is set out below. Firstly, the movements which are required during changes from one thickness of material to a second thickness of the material will be described in detail. Thereafter structure permitting alignment for the angle α and parallel alignment of the roller die shafts 120 and 118 will be explained in detail.

Figure 9:
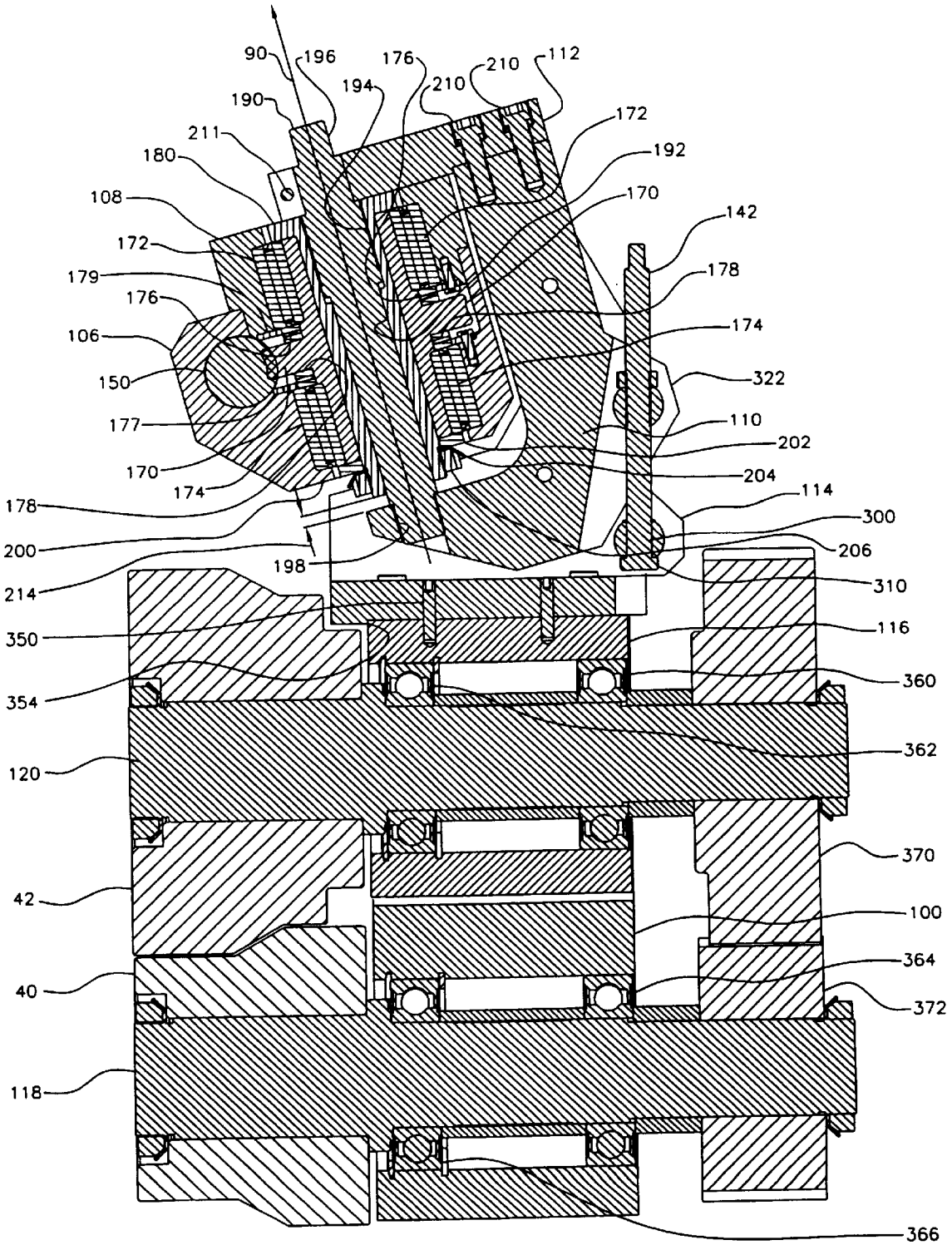
FIG. 9 is a vertical cross-section through the station of FIG. 8 alone line 9—9 of FIG. 8.
Figure 10:
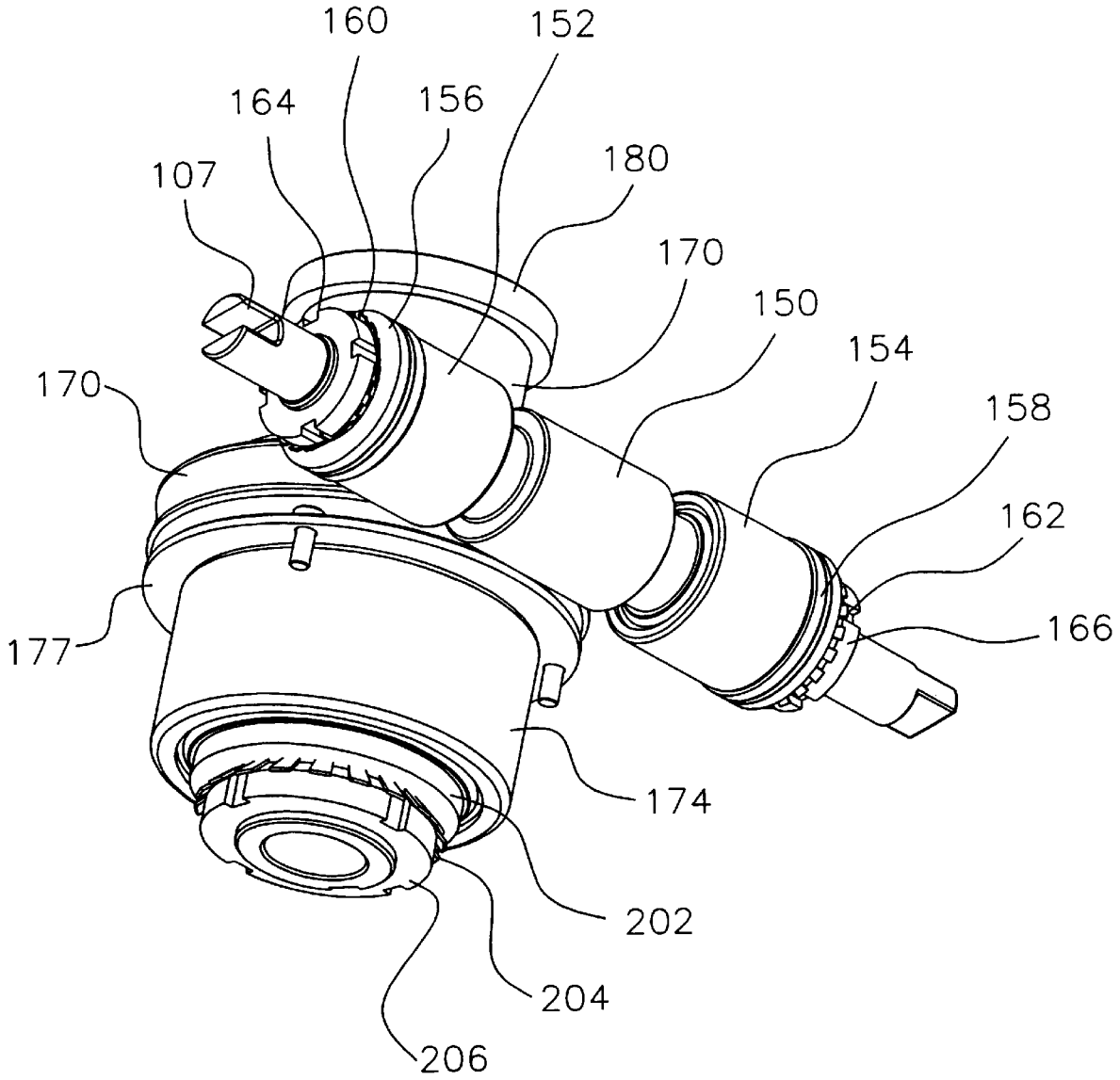
FIG. 10 illustrates the assembly of some of the components of the station of FIG. 8 with other of the components removed for clarity.

The thickness adjustment structure which permits movement of the upper roller die shaft 118 to accommodate materials of differing thicknesses may most clearly be understood by reference to FIGS. 9 and 10. FIG. 9 is a cross-section through the apparatus of FIG. 8. FIG. 10 illustrates the gear train components and drive mechanism which causes the movement, the gear train having been separated from its surrounding and Supporting housing structure.

The drive shaft 107 (FIG. 10) includes a worm 150 visible in FIGS. 9 and 10. The drive shaft 107 is located and supported in bearings 152 and 154. The bearings 152 and 154 are needle bearings and additional bearings 156 and 158 are thrust bearings to take axial loads along the shaft 107. The bearings are held in place by lock washers 160 and 162, which in turn are held in place by lock nuts 164 and 166. The bearings 152 and 154 support the shaft 107 in the gear housing 106.

The worm 150 is meshed with a worm gear 170. The worm gear 170 is supported within needle bearings 172 and 174 for rotation about the direction of travel 90. Thrust loads parallel to the direction of travel 90 are taken by thrust bearings 176 and 178. The bearings are held by bearing retaining rings 177 and 179.

Figure 11:
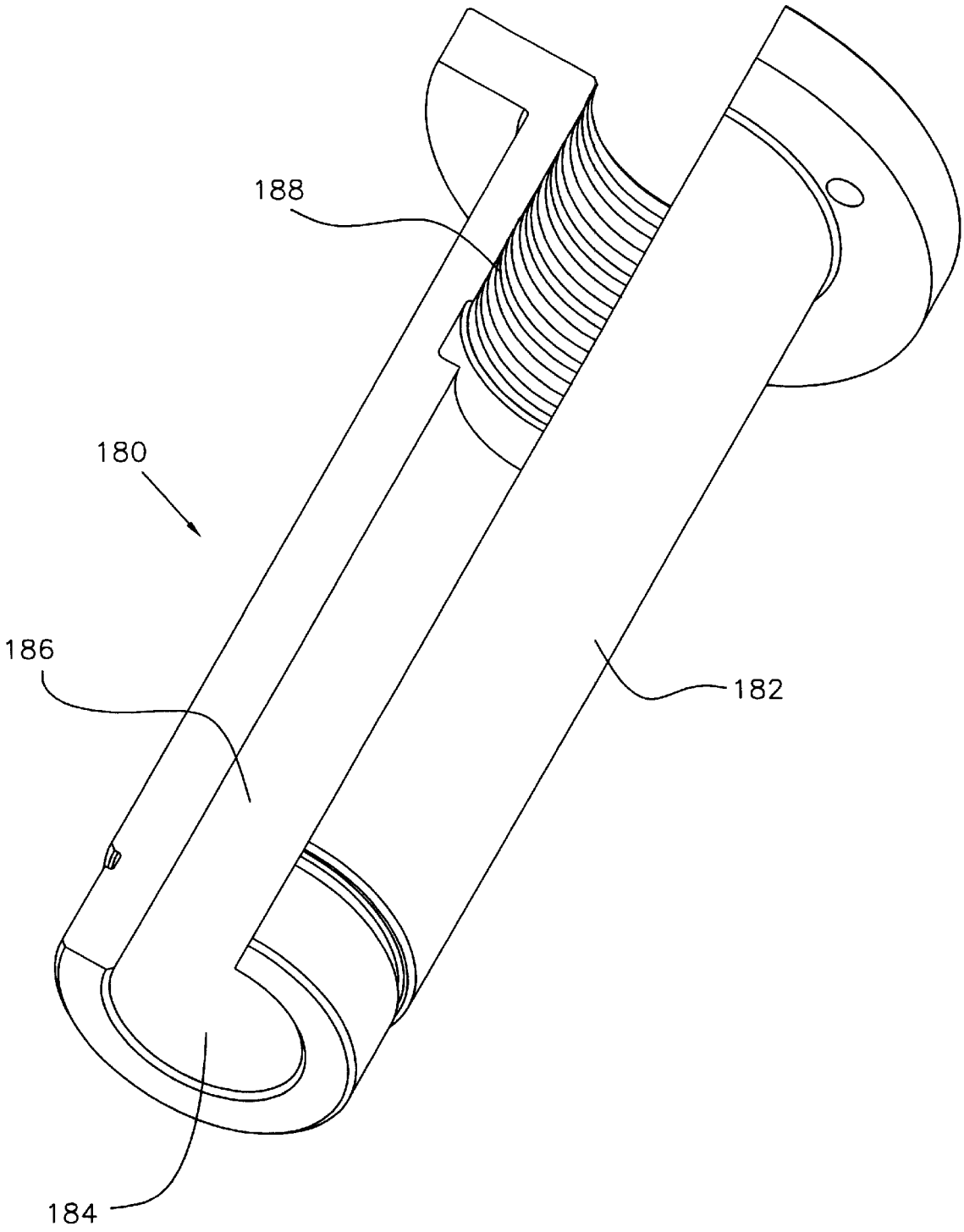
FIG. 11 illustrates one of the components of FIG. 10.

The worm gear 170 comprises a central bore extending axially through the worm gear 170. The bore of the worm gear 170 closely accommodates an thickness adjusting insert 180. The thickness adjusting insert 180 is shown in more detail in FIG. 11. The thickness adjusting insert 180 comprises a smooth substantially cylindrical outside surface 182. In addition, the thickness adjusting insert 180 comprises a central bore 184. The central bore 184 comprises a first portion 186 defining a substantially cylindrical bearing surface and a second portion defining a threaded bore 188. The diameter of the bearing surface 186 is smaller than the diameter than the threaded bore 188.

Figure 12:
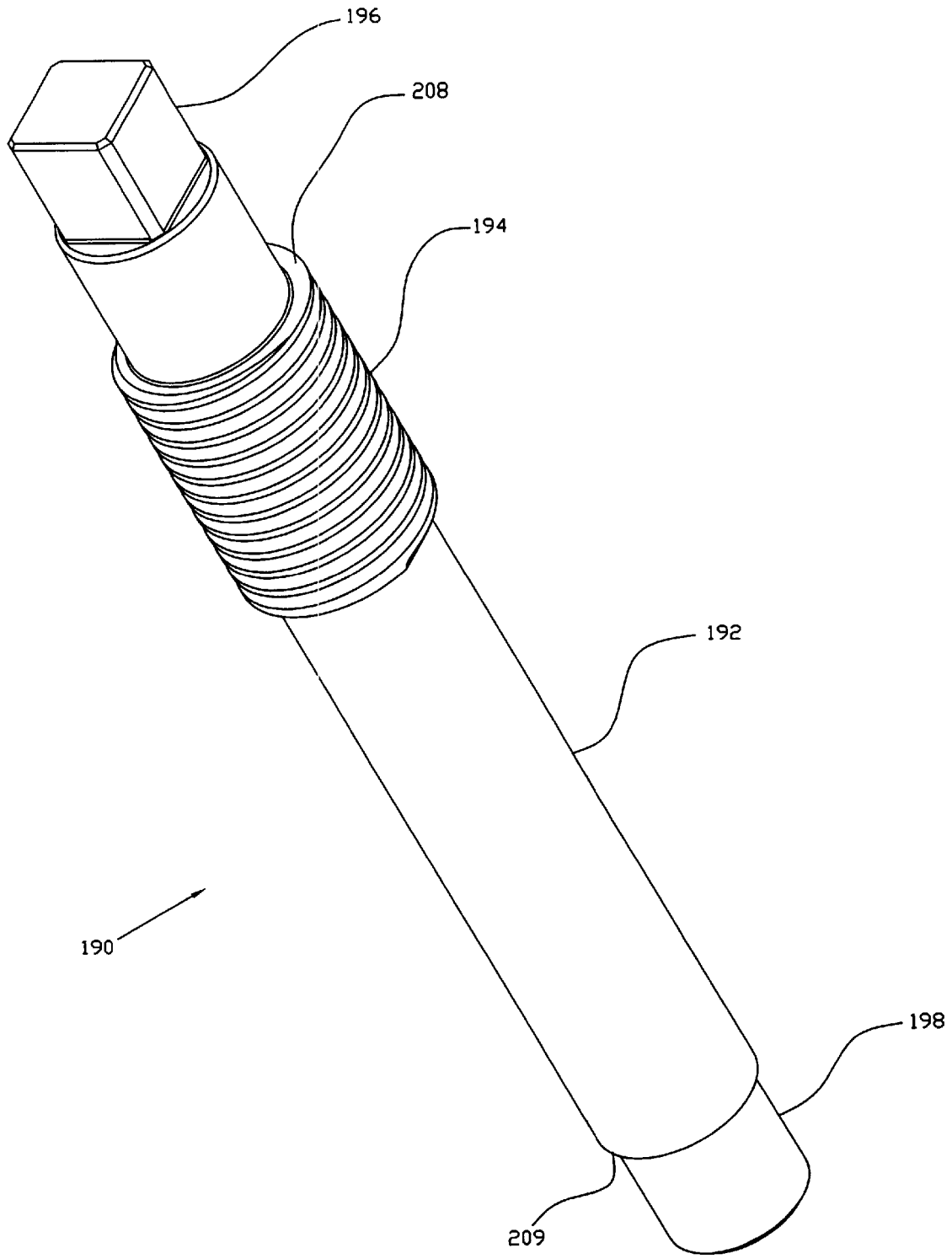
FIG. 12 illustrates a component of the station of FIG. 8.

An thickness adjustment screw 190 is illustrated in FIG. 12. The thickness adjustment screw 190 comprises a cylindrical surface 192 and a threaded portion 194. In addition, the thickness adjustment screw 190 comprises an adjustment head 196 at one end of the thickness adjustment screw and a bearing surface 198 at the other end of the thickness adjustment screw.

The bearing surface 198 of the thickness adjustment screw 190 is received within a complimentary bore in the adjustment block 110 (see FIG. 9). The roller bearing 174 is seated on a lip 200 of the gear housing 106 at the outer race. The inner race of the bearing 174 is supported by a retaining ring 202. The retaining ring 202 is held in position by the lock washer 204 and the lock nut 206.

The gear housing cover 108 captures the bearing 172 at its upper extremity in respect of the outer race of the needle bearing 172. The thickness adjusting insert 180 captures the needle bearing 172 adjacent the inner race. The adjusting block plate 112 bears against a shoulder 208 (FIG. 12) of the thickness adjustment screw 190. The adjustment block plate 112 is held to the adjustment block 110 by means of two cap screws 210. The thickness adjustment screw 190 has a shoulder 209 which bears against the adjusting block 110.

Reviewing now FIG. 9, the principal of movement of the adjusting block 110 may be understood. Rotation of the drive shaft 107 causes rotation of the worm 150 which is affixed to the drive shaft 107. The worm 150 meshes with the worm gear 170. Thus, turning of the worm 150 causes the worm gear 170 to rotate about the axis defined by the direction of travel 90. Rotation of the worm gear 170 causes rotation of the thickness adjusting insert 180 which is fixed thereto. The exterior surface 182 of the thickness adjusting insert 180 is fitted tightly to the interior bore of the worm gear 170. As the thickness adjusting insert 180 revolves, the thread of the threaded bore 188 of the thickness adjusting insert interacts with the thread of the threaded portion 194 of the thickness adjustment screw 190. Thickness adjustment screw 190 cannot rotate within the adjustment block 110 as it is held tightly by means of set screw 211. Because the thickness adjustment screw 190 does not turn, and as there is a threaded engagement between the threads 188 and 194, then rotation of the thickness adjusting insert 180 causes relative longitudinal motion of the thickness adjustment screw 190 relative to the thickness adjusting insert 180. The thickness adjustment screw 190 will therefore move longitudinally in the direction of travel 90, up or down as shown in FIG. 9, depending upon the direction of the rotation of the worm 150.

As the thickness adjustment screw 190 is fixed within the adjustment block 110, by shoulders 208 and 209 then the adjustment block 112 and all of the structure attached thereto will move in the direction of travel 90. The adjustment block 110 is connected to the upper bearing block 116 as explained above, through the levelling block 114 and thus the upper bearing block 116 will also move in the direction of travel 90.

As shown in FIG. 9, the adjustment block plate 112 is in contact with the upper surface of the gear housing cover 108 and thus the thickness adjustment screw 190 cannot move downwardly from the position shown in FIG. 9. The clearance between the lower roller die 40 and the upper roller die 42 is thus at the minimum level in FIG. 9. If thicker material is to be placed between the roller dies 40 and 42, then roller die 42 is moved upwardly along the direction of travel 90. The dimension illustrated in FIG. 9 and marked as 214 is the maximum amount of travel before a surface on the adjustment block 110 would contact the lower portion of the thickness adjusting insert 180. This dimension can be any convenient dimension by simply arranging the configuration of the adjustment block 110 to permit the desired amount of adjustment.

The amount that the thickness adjustment screw 190 moves upon one rotation of the shaft 107 is a function of the gearing of the various elements in the structure. There is a gearing reduction between the worm 150 and the worm gear 170. For convenience in manufacturing the device, it is suggested that all of the worms 150 and all of the worm gears 170 be manufactured with the same configuration, that is, having the same gear reduction therebetween.

The second component in what is in effect a gear train is the pitch of the thread 188 of the thickness adjusting insert 180 and the corresponding thread 194 of the thickness adjustment screw 190. Different amounts of adjustment of each individual station 98 may be achieved by having a different set of thickness adjustment screw 190 and adjustment insert 180 at each station. By way of example, the pitch of a station adjacent the final stages of bending where a approaches 90° may be eight turns per inch, while the pitch of a station closer to the beginning end of the assembly may be ten threads per inch. With this type of system, then equal rotation of the shaft 107 produces equal revolution of the worms 150 in all stations and an equal number of revolutions of the worm gears 170 in each station, but a different amount of movement of the thickness adjustment screw 190. A higher pitch, that is eight threads to the inch will produce greater movement of the thickness adjustment screw 190 than a lower pitch, that is, ten threads per inch of an thickness adjustment screw 190 in another station.

Figure 13:
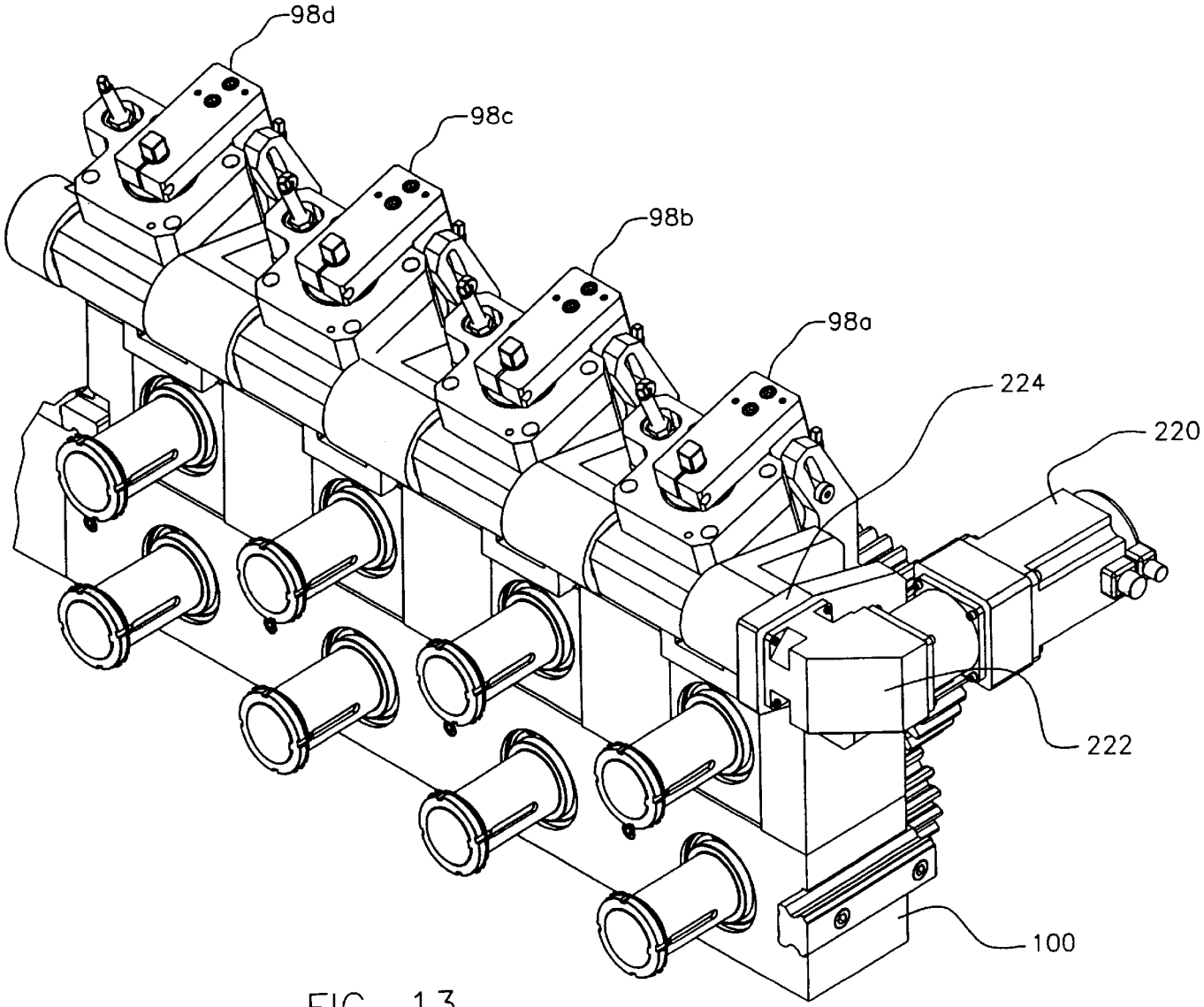
FIG. 13 illustrates a plurality of stations of the roll forming machine of FIG. 2.

FIG. 13 illustrates 4 stations 98*a*, 98*b*, 98*c* and 98*d* comprising a portion of the right assembly 32. An thickness adjustment drive motor 220 is connected to a right angle gear box 222 and drives the drive shaft 107 of each of the stations. The drive shaft of each of the stations are interconnected as explained below.

Upon operation of thickness adjustment drive motor 220, the aligned drive shafts 107 all turn at the same time and all turn the same number of revolutions. Because each of the stations is operating at a different angle $\alpha$ the adjustment will be in a different direction at each station and in each station the direction of adjustment will be directly related to the angle $\alpha$ of the roller dies at that station as explained with reference to FIG. 7. If each of the stations has the same pitch for the thickness adjusting insert and the thickness adjustment screw, then all stations will move a similar amount but in a different direction. If different sets of thickness adjusting inserts and thickness adjustment screws are used at each station, then a different amount of travel will be accomplished in each station.

As explained above, with the structure herein disclosed, it is possible to equip each station 98 with a different set of thickness adjusting insert and thickness adjustment screw to achieve the mount of motion along the direction of travel 90 so that precisely accurate adjustment as explained in connection with FIG. 7 may be accomplished. While that is the preferred embodiment of the invention, and while that structure enables the greatest degree of accuracy in making the necessary adjustments, such accuracy may not necessarily be required at all times. It is believed the most important feature is that the direction of movement 90 be directly related to each angle $\alpha$ for each station. It is less important that the exact amount of movement in the direction 90 be accomplished. This is particularly true if the difference between the maximum thickness to be handled by the roll forming machine is not substantially greater than the minimum thickness to be handled by the same roll forming machine. The following example will show that these approximations are acceptable if the range of thicknesses is not too great FIG. 14 is a view similar to FIG. 7. This figure shows the directions of travel 90*d* and 90*h* for two stations 98*d* and 98*h*. In the illustration set out in FIG. 14, station 98*d* has an α angle of 30° while station 98*h* has an a angle of 90°.

The dimension To indicates the minimum thickness of material to be handled at that station. The dimension T-max is the maximum material thickness to be handled at that station. The difference between T-max and To is illustrated as Xo, that is the maximum variation permitted. The dimension $X_1$ illustrates the distance along the direction of travel 90*h* which is the amount the upper roller die 42*h* should move to accommodate the additional thickness of material. The dimension $X_2$ is the amount the upper roller die 42*d* should move to accommodate the same additional thickness of material. As explained above, $X_1$ for an α of 90° is considerably larger than $X_2$ for an α angle of 30°.

Empirically we have recognized that the maximum differential for $X_1$ minus $X_2$ should be no greater than approximately ten thousandths of an inch (0.010). Because of the trigonometric relationships involved ($X_1$=1.142$X_0$, $X_2$=1.0353$X_0$, $X_1$−$X_2$=0.3789 $X_0$), and setting the maximum differential at 0.010 gives the figure that $$X_0 = \frac{0.010}{0.3789} = 0.0264.$$

This in turn means that the maximum thickness variation between the thickest material and the thinnest material must be no greater than approximately 0.026 if all stations have the same pitch for the thickness adjusting insert 180 and the thickness adjustment screw 190.

The difference in material which is gauge 10 (0.141) and material which is gauge 12 (0.109) is approximately 0.030. Similarly, the difference in material which is gauge 13 (0.094) and material which is gauge 16 (0.062) is also approximately 0.030. Finally, the difference between material which is gauge 17 (0.056) and material which is gauge 24 (0.025) is also approximately 0.30. Accordingly, if a particular roll forming machine is only to handle materials ranging from gauge 10 to 12 or materials ranging from gauges 13 to 16 or materials ranging from gauges 17 to 24, then it may be possible to use the same pitch for the sets of thickness adjusting inserts and thickness adjustment screws for all of the stations. In such a case, in order to average the error, the calculated amount of movement is selected for an α angle of approximately 75°. This means that for α angles greater than 75° the amount of movement will be slightly less than required, while for angles of a less than 75° slightly more movement will be achieved than required. By splitting the error in this way, the amount of error is acceptable for most practical purposes.

There is not much difference between an $X_0$ and $X_1$ for small angles of α below 30°. Thus, for practical reasons, it is appropriate to consider the issue for angles of 30° and higher.

Where a machine is to be designed to handle a greater range of gauges such as from gauge 16 to gauge 10, a difference of 0.141 minus 0.062 or 0.080, then two sets of thickness adjusting insert and thickness adjustment screw might advantageously be used. In this example, those stations having α angles from 0 to 50 can be equipped with thickness adjusting insert and thickness adjustment screw sets having a pitch of 10 threads per inch, while stations having an α angle of 50 to 90 can be equipped with thickness adjusting insert and thickness adjustment screw sets having a pitch of 8 threads per inch thereby giving more movement. In the case of the first set, the pitch is selected to give the calculated amount of movement at an α angle of 30. The second set is adjusted to give the calculated amount of movement for the α angle of 75.

It is to be appreciated, that the approximations set out above, are possible, because in each station, the direction of movement is different and is directly related to the α angle pertinent to that station. The greatest accuracy is achieved by having unique sets of thickness adjusting insert and thickness adjustment screw at each station, but for practical purposes, the approximations set out above produce satisfactory results.

In order to initially position the adjustment block 110, the structure described above is assembled as shown in FIG. 9. the set screw 211 is left loose. With the set screw 211 loose, the thickness adjustment screw 190 can be rotated within the adjustment block plate 112 and the adjustment block 110 by means of a tool such as a wrench or socket applied to adjustment head 196. Rotation of the thickness adjustment screw 190 while the worm gear 170 and thickness adjusting insert 180 remain stationary raises or lowers the adjustment block 110 and related structure. This enables the correct initial clearance to be established between the roller dies 42 and 40 for initial set up. Once the initial clearance is achieved the set screw 211 is tightened so that the split portion of locking block plate 112 captures the thickness adjustment screw 190 preventing any further relative rotation.

Reference will now be made to the mechanism of the present device which permits adjustment of the angle α. It will be recognized that once set up for a particular roller die set, the α angle would not change unless the roller dies themselves are changed. The advantage of having a mechanism which is adjustable for the angle α is that a single mechanism may be produced which is usable for each of the stations 98 and which may be adjusted if different roller dies are substituted at a station.

Figure 15:
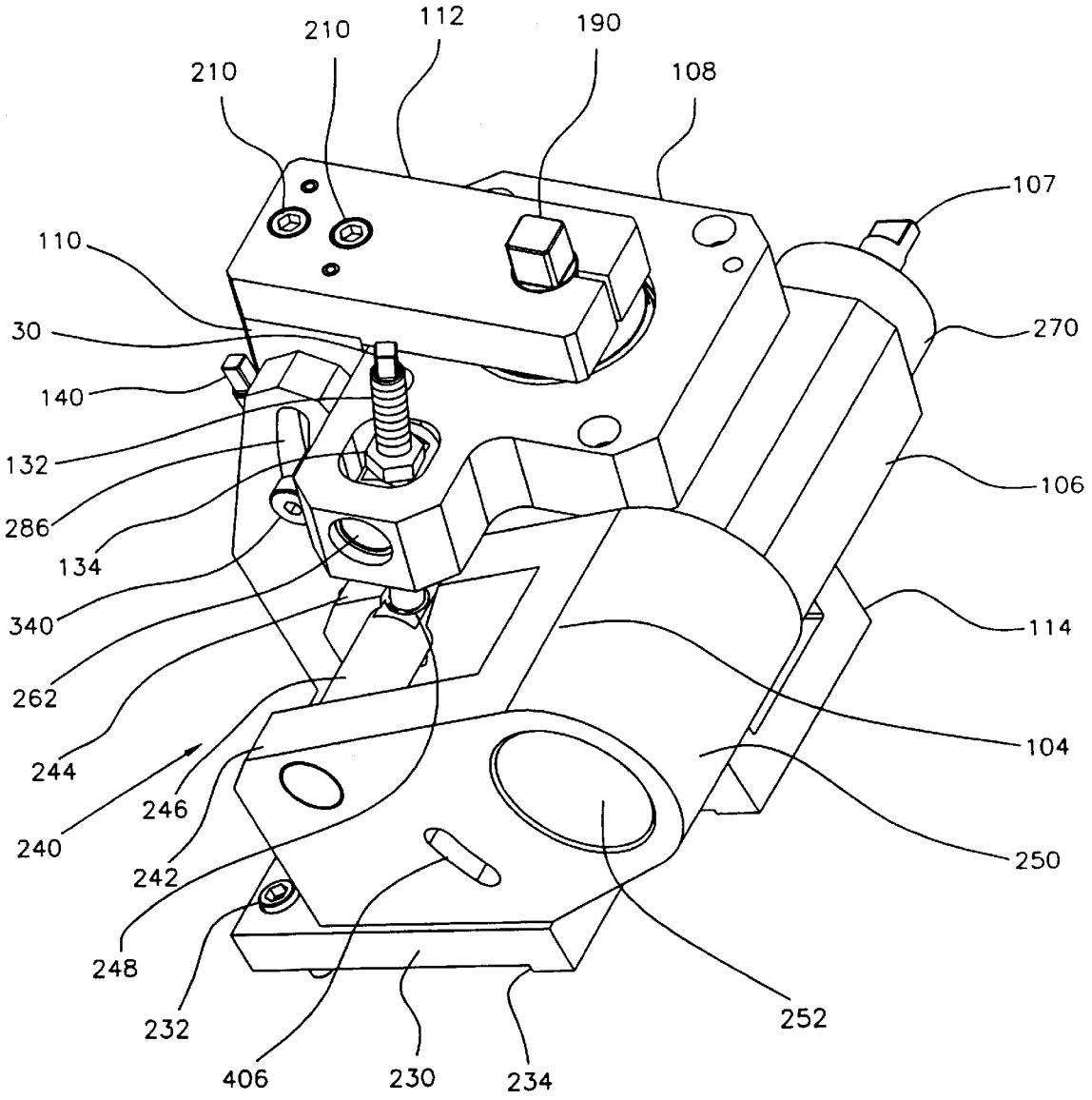
FIG. 15 is a left side perspective view of an assembly of some of the components of FIG. 8.

FIG. 15 illustrates the assembly of the pivot bracket 104 and the gear housing 106. Reference may also conveniently be made to FIG. 16 which illustrates the gear housing 106 and the gear housing cover 108.

The pivot bracket 104 comprises a mounting plate 230. The interaction of a cap screw 232 and a lip 234 serve to rigidly affix the pivot bracket 104 to the separator block 102. It will be recalled that the separator block 102 is permanently affixed to the lower base block 100. Thus, there is no motion of the pivot bracket 104 relative to the lower base block 100.

The pivot bracket 104 has a clevis portion 240 made up of arms 242 and 244. A slotted shaft 246 is the first α adjustment shaft. The slotted shaft 246 extends between the arms 242 and 244. The α adjustment screw 130 is captured within a bore in the shaft 246 by means of the head of the α adjustment screw 130 and a lock ring 248. The pivot bracket 104 comprises a substantially cylindrical portion 250 having an internal cylindrical bore 252.

Figure 16:
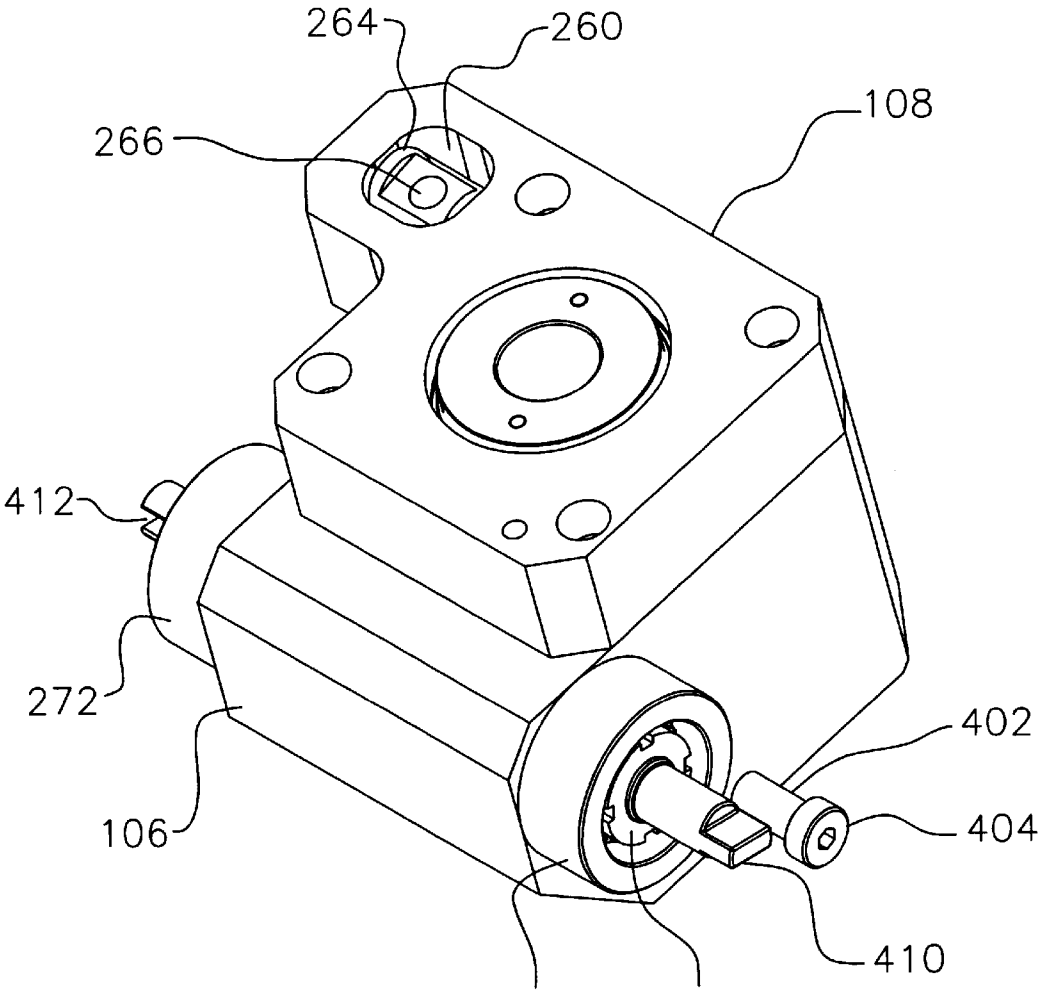
FIG. 16 is a right side perspective view of one of the components of FIG. 15.
Figure 17:
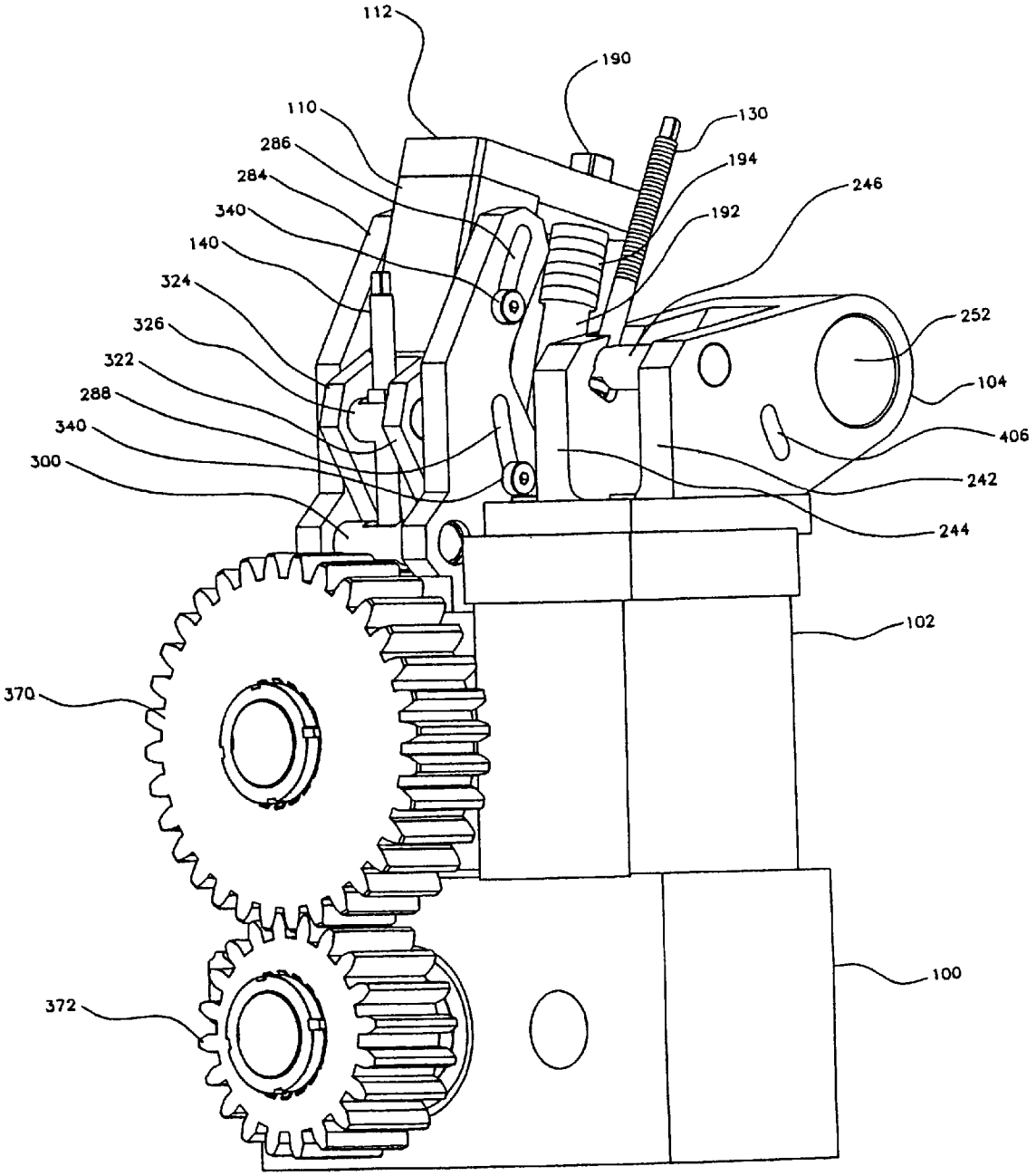
FIG. 17 is a right rear perspective of the station of FIG. 8 with the gear housing removed.

From reference to FIG. 16, it will be observed that the gear housing cover 108 comprises an aperture 260. The aperture 260 passes vertically through the gear housing cover. There is a horizontal bore 262 illustrated in FIG. 15. The gear housing cover 108 further comprises a second α adjustment shaft 264 having a bore 266 which is threaded.

The shaft 264 is placed within the bore 260 by sliding the shaft horizontally through the bore 262 and snap ring are employed to retain the shaft in the bore 262. The α adjustment screw 130 comprises an upper threaded portion 132 which is received in the threaded portion of the bore 266.

The α adjustment screw 130 is mounted in the shaft 246 to permit relative rotation of the α adjustment screw 130 about its general axis. The α adjustment screw 130 is threadedly received within the gear housing cover 108 by means of inter-reaction of the threaded portion 132 of the α adjustment screw 130 and the threaded bore 266 of the gear housing cover 108. The relative position of the gear housing 108 with respect to the α adjustment screw 130 is further maintained by lock nut 134.

The gear housing 106 comprises two bosses 270 and 272 (see FIG. 16). Boss 272, fits within and is closely received in the bore 252.

Pivot bracket 104 is fixed to the lower base block 100 as explained above. The gear housing 106 contains the bearings 152 and 154 locating the drive shaft 107. Thus, the gear housing 106 can pivot about the shaft 107. The relative angular location between the pivot bracket 104 and the gear housing 106 is determined by adjusting the α adjustment screw 130. When the lock nut 134 is slackened off, rotation of the α adjustment screw 130 has the effect of rotating the gear housing 106 and all structure attached thereto about the axis of the drive shaft 107. Note that as the gear housing rotates, the worm gear 170 will also move but will remain meshed with the worm 150. The movement of the gear housing 106 permits adjustment of all of the mechanism attached to the gear housing 106 to achieve the appropriate angle α. As the gear housing 106 and gear housing cover 108 rotate about the axis of the shaft 107 they carry with them the adjustment block 110 and the adjustment block plate 112. Therefore the adjustment block is also rotating about the axis of the drive shaft 107. The levelling block 114 is attached to the adjustment block 110 and therefore also rotates with it. Finally, the upper bearing block 116 is attached to the levelling block 114 and thus the upper bearing block also rotates about the axis of the drive shaft 107. This permits the structure to be adjusted to any angle α, the working angle of the roller die set comprising the lower roller die 40 and the upper roller die 42.

From the above explanation, it will be recognized that the upper bearing block 116 can be made to rotate about the axis of the drive shaft 107 by means of the operation of the α thickness adjustment screw. Because the upper bearing block 116 is travelling about a pivotal axis defined by the shaft 107, then once the upper bearing block is moved, the upper roller die shaft 118 may no longer be parallel to the lower roller die shaft 120.

In order to adjust the upper roller block 116, so that the upper roller die shaft 118 can be adjusted to be parallel to the lower roller die shaft 120, there is a parallel adjustable connection between the adjustment block 110 and the levelling block 114.

Figure 18:
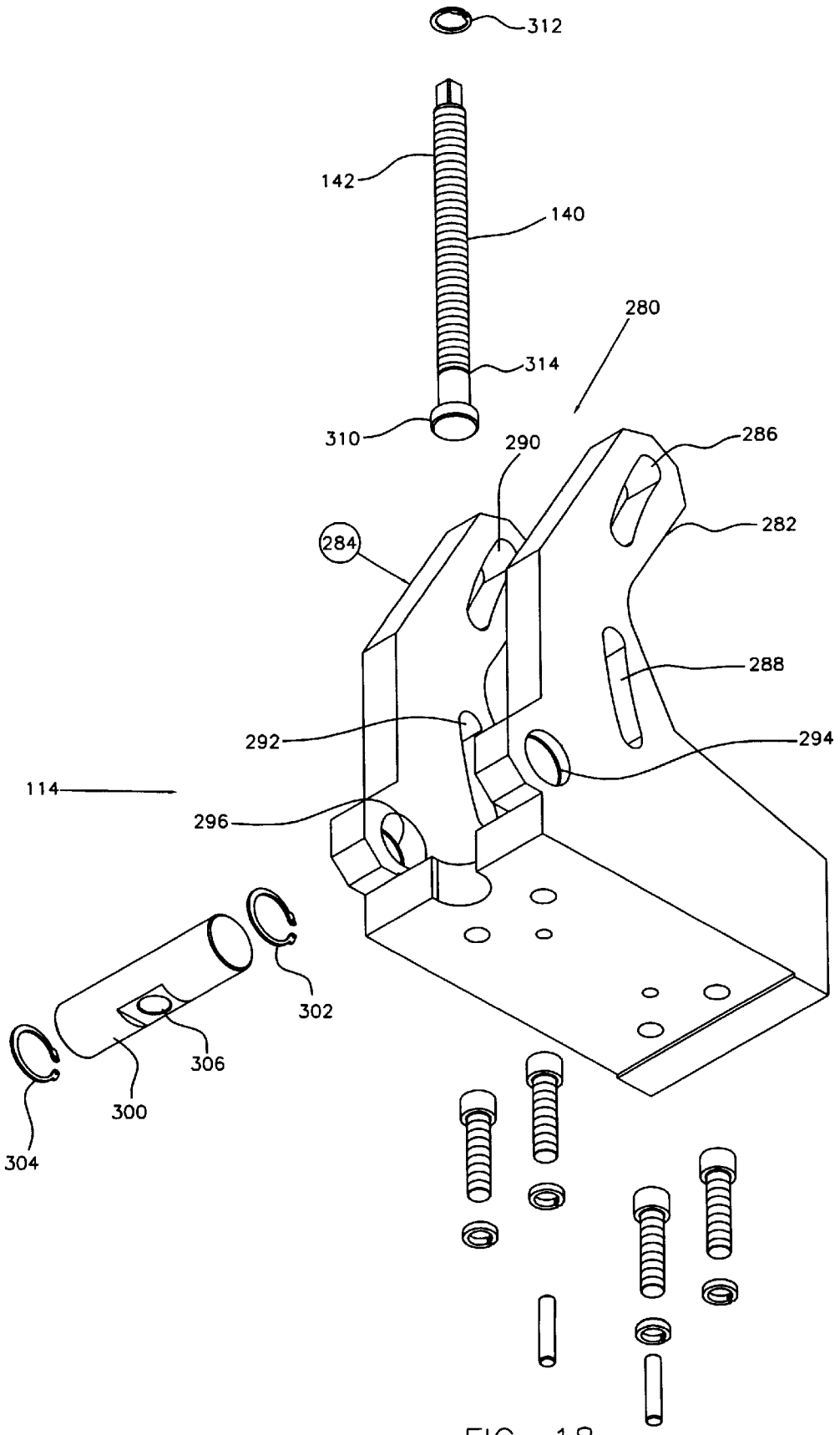
FIG. 18 is an exploded assembly drawing of one of the components of the station of FIG. 8.
Figure 20:
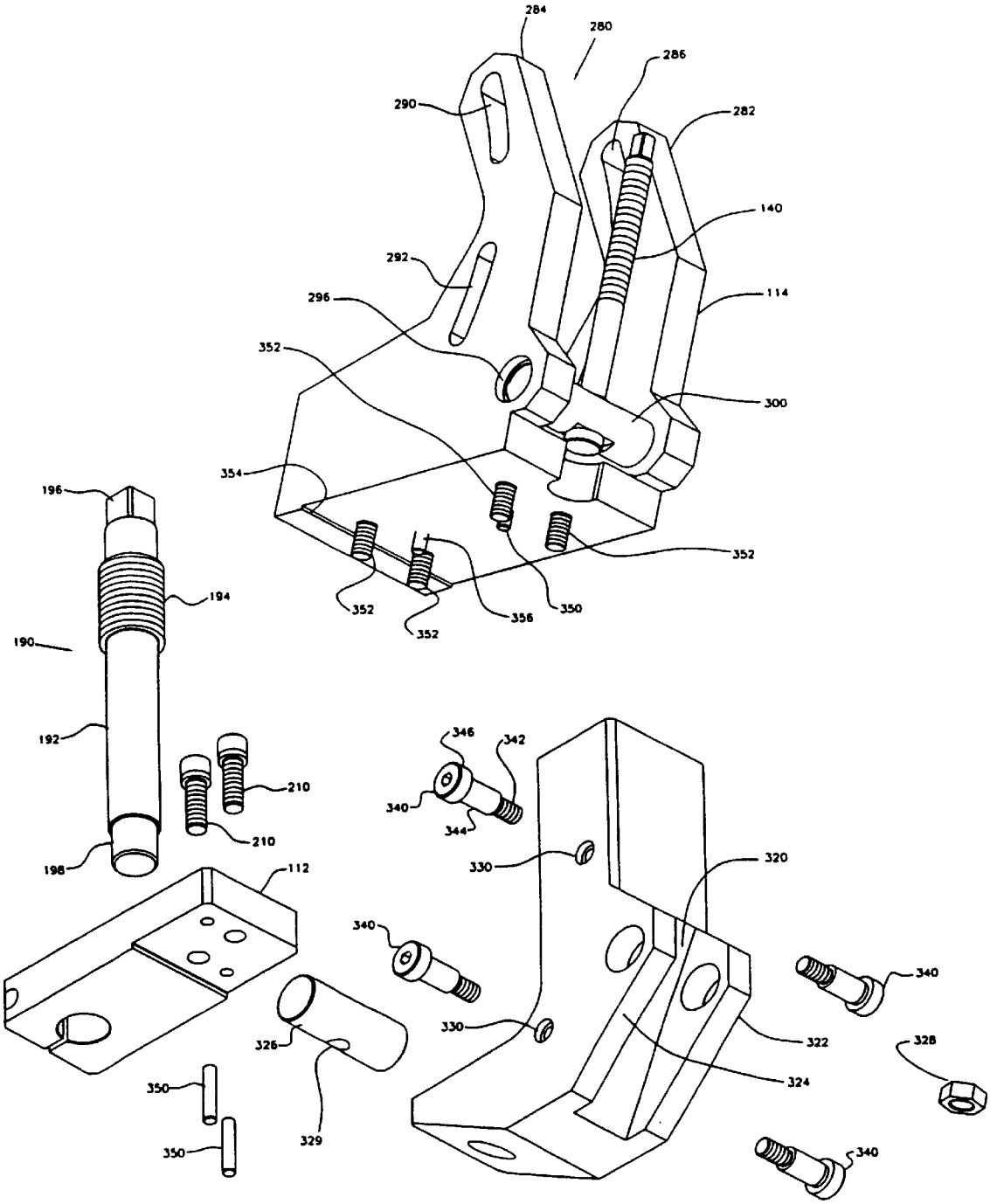
FIG. 20 is an exploded assembly diagram of some of the components of the station of FIG. 8.

An exploded view of the levelling block 114 is illustrated in FIGS. 18 and 20. The levelling block 114 comprises a clevis 280 comprised of arms 282 and 284. The arm 282 defines arcuate slots 286 and 288. The arm 284 defines similar arcuate slots 290 and 292. The arm 282 also includes a horizontally extending bore 294, while the arm 284 has a similar horizontally extending bore 296. The bores 294 and 296 receive a first parallel adjustment shaft 300. The shaft 300 may be held within the bores 294 and 296 by retainers 302 and 304. The shaft 300 has a bore 306 extending therethrough. The bore 306 in the shaft 300 is not threaded and receives the parallel adjustment screw 140. The parallel adjustment screw 140 is held within the bore 306 of the shaft 300 by means of a head 310 and a lock clip 312 which fits within a groove 314 of the parallel adjustment screw 140. The parallel adjustment screw 140 comprises a threaded portion 142.

Figure 19:
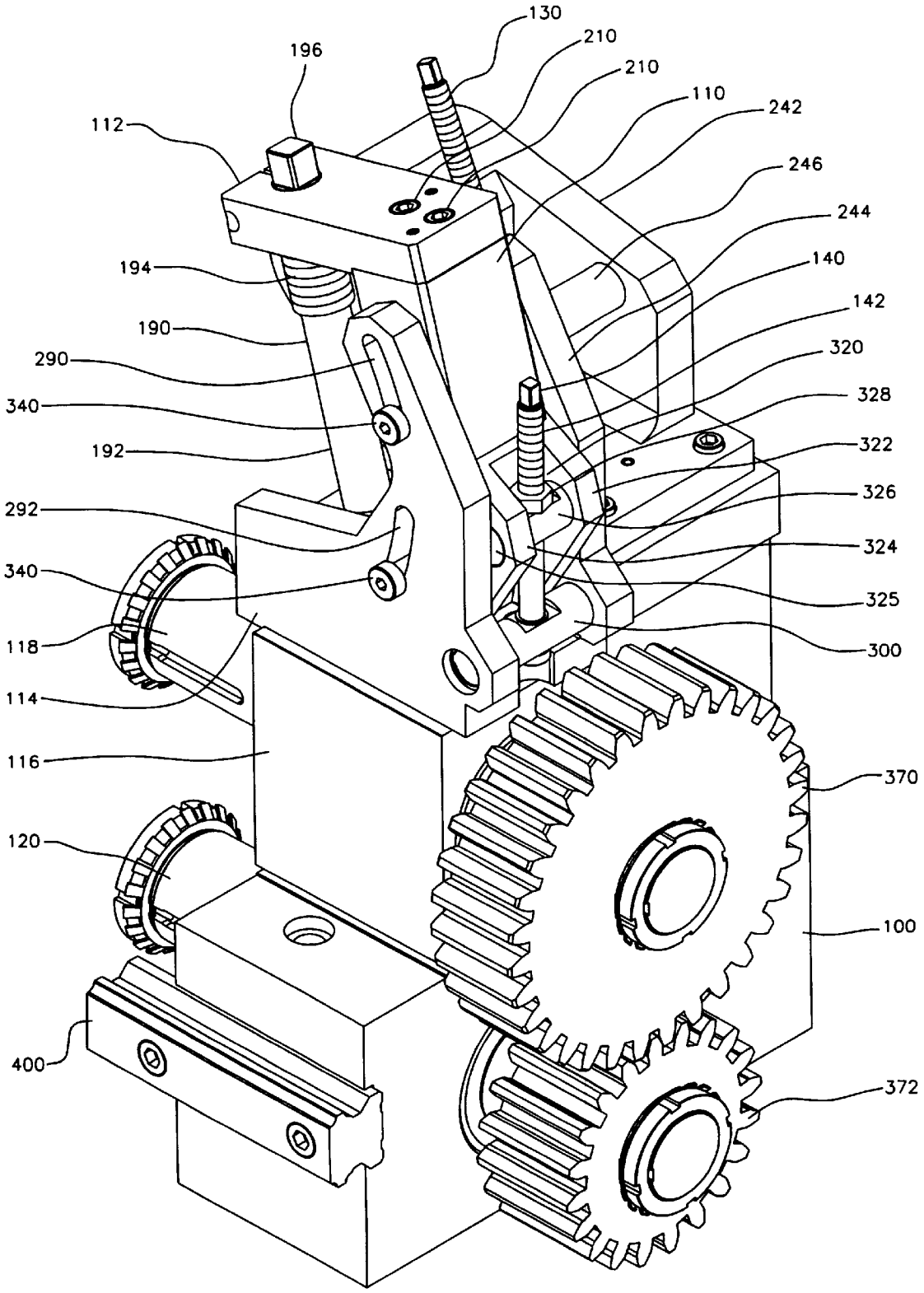
FIG. 19 is a left rear perspective view of the station of FIG. 8 with the gear housing removed.

Referring now to FIGS. 19 and 20, it will be noted that adjustment block 110 comprises a devis 320 comprised of arms 322 and 324. The arms 322 and 324 each define a horizontally extending bore 325 and 327, the bore 325 of arm 324 is illustrated in FIG. 19. A second parallel adjustment shaft 326 extends between and is located by the bores 325 and 327 in arms 322 and 324 and is held in place by a structure similar to that explained in association with shaft 300. The shaft 326 has a central bore 329 which is illustrated in FIG. 20, which is threaded to receive the threaded portion 142 of the parallel adjustment screw 140.

The parallel adjustment screw 140 operates in a fashion similar to the α adjustment screw 130. The parallel adjustment screw 140 is received within shaft 300 so that the parallel adjustment screw 140 may rotate. Upon rotation of the parallel rotation screw 140, the shaft 326 will move up or down along the thread 142 of the parallel adjustment screw 140. When a final position is achieved, then further rotation is prevented by lock nut 328.

As the parallel adjustment screw 140 is moved, the levelling block 114 will move relative to the adjustment block 110. The axis for relative pivotal motion of the levelling block 114 relative to adjustment block 110 is the axis of the drive shaft 107. The levelling block 114 is not however in any way connected to shaft 107 or its bearings. Thus, the axis of the drive shaft 107 is a virtual pivotal axis. The virtual pivotal axis movement, is produced by the inter-reaction of the arcuate slots 286, 288, 290 and 292 with shoulder bolts explained below. The arcuate slots are defined by an arc centred at the axis of the drive shaft 107.

FIG. 20 is an exploded diagram illustrating the levelling block 114 and the adjustment block 110 and their respective component parts. The adjustment block 110 comprises four threaded bores 330, two of which are visible in FIG. 20. The threaded bores 330 each receive a single threaded shoulder screw 340. The shoulder screws 340 have a threaded portion 342, shoulder portion 344, and a head portion 346.

The shoulder portion 344 of the shoulder screws 340 has a diameter which is substantially equal to the width of the slots 286, 288, 290 and 292. Thus, the slots may slide along the shoulder screws but there is no radial motion toward or away from the axis of the shaft 107 or any movement parallel to the axis of shaft 107. Movement of the slots relative to the shoulder screws is thus circumferential movement along an arc centered at the axis of the shaft 107. When the appropriate location of the upper bearing block 116 has been determined by rotation of the parallel adjustment screw 140, the shoulder screws 340 are each tightened into the adjustment block 110 so that the head 346 of the shoulder screws 340 bears against the arms 282 and 284 of the levelling block 114. This, then maintains the relative location of the levelling block 114 with respect to the adjustment block 110.

The levelling block 114 is affixed to the upper bearing block 116 by means of two dowels 350, four screws 352 and a lip 354 which bears against the surface of the upper bearing block 116.

The upper roller die shaft 118 is supported in the upper bearing block 116 on roller bearings 360 and 362 (FIG. 9). The lower roller die shaft 120 is supported in the lower base block 100 on roller bearings 364 and 366. Spur gears 370 and 372 interconnect the upper roller die shaft 118 and lower roller die shaft 120. As the upper roller die shaft 118 is moved in the direction of travel 90, the teeth of the spur gears move vertically and laterally but remain engaged so as to provide the necessary drive forces.

Attention is now directed to FIG. 8. From reference to FIG. 8, which shows a first station 98*a*, there is a substantially horizontal slide rail 400. The slide rail 400 is used in laterally adjusting the width between the left assembly 30 and the right assembly 32. The whole assembly of left lower base block 100 and the stations 98 supported thereon can be moved closer or farther away from the left base block 100 as needed to accommodate the width of material being fed into the roll forming machine 12.

In assembling a plurality of stations to the lower base block 100, it is desirable that all of the shafts 107 interconnect and that the adjacent stations 98 provide additional support for one another. By reviewing FIG. 15, it will be noted that the bore 252 is open at the left end as shown in FIG. 15. Also, visible in FIG. 15 is a bushing 270. The bushing 270 of the next adjacent station to the left as shown in FIG. 15 will be received within the bore 252 thereby providing structural support for the next adjacent station. With reference to FIG. 16, it will be observed that the gear housing 106 further comprises a shoulder screw 402 which projects from one side face of the gear housing 106. The shoulder screw 402 has a head 404. From reference to FIG. 15, it will be observed that the pivot bracket 104, comprises an arcuate slot 406. Slot 406 in arm 242 of the pivot bracket 104 comprises an arc centered at the axis of the shaft 107. The screw 402 is received within the slot 406. In this manner, the gear housing 106 of the next adjacent unit to the left as shown in FIG. 15 is supported not only by the pivot block to which it is affixed but also by the inter-reaction of bushing 270 with bore 252 and the inter-reaction of screw 402 with slot 406. In addition, the gear housing 106 also includes a shoulder screw which is the same as shoulder screw 402 which projects toward the pivot bracket 104. Arm 244 of the pivot bracket includes an arcuate slot the same as slot 406. This structure is not visible in the assembly but additionally acts to support the gear housing 106 with respect to the pivot block 104 within the station 98.

With reference to FIG. 16, it may be observed, that the drive shaft 107, is fitted with a male end 410 adjacent the shoulder screw 402 and a corresponding female end 412 on the other end. The male end of the first station in the array is received in the gear box connector 224. As each subsequent station is assembled to the lower base block 100, the male end 410 is received within the female end 412 of the next adjacent station. This provides a continuous drive shaft 107 made up of individual longitudinal alignment sections extending the length of the plurality of stations, all of which are interconnected to turn the same number of revolutions upon drive being supplied by the motor 220 through gear box 222.

The assembly of the roll forming machine 12 starts with the lower base block 100. A motor support block 226 is first bolted to the lower base block. Then a first station 98 is assembled to the lower base block 100. The upper bearing block 116 of the first station 98*a* is supported in the longitudinal direction by the separator block 102*a* and the motor support block 226. The next station 98*b* is then added to the lower base block 100. The longitudinal support for upper bearing block 116*b* is provided by separator block 102*b* and the separator block 102*a*. Assembly can then continue for the desired number of stations.

While a preferred embodiment of the invention has been described herein in detail, it is to be understood that this description is by way of example only and is not intended to be limiting. The full scope of the invention is to be determined from reference to the appended claims.

We claim:

1. A roll forming machine, said roll forming machine comprising;

a plurality of stations for forming a flat metal strip into a product, each of said stations having a roller die set comprising a first roller die and a second roller die, said roller die set defining an angle $\alpha$ for bending said metal strip, each of said stations having a different angle $\alpha$, thickness adjustment means for moving one of said roller dies of said roller die set relative to the other of said roller dies of each particular station, in a direction of travel directly related to the angle $\alpha$ of said particular station for adjusting said station to be able to form products from different thicknesses of said metal strip, and common operating means for operating said adjustment means of each of said stations simultaneously.

2. The device of claim 1 wherein said common operating means comprises a shaft having a longitudinal axis, and said shaft is mounted in bearings for rotation about said axis.

3. The device of claim 2 further including motor means for rotating said shaft.

4. The device of claim 3 wherein said shaft comprises a worm, and each said station comprises a worm gear meshing with said worm.

5. The device of claim 4 wherein said thickness adjustment means comprises a thickness adjustment insert and a thickness adjustment screw.

6. The device of claim 5 wherein said thickness adjustment insert is mounted to said worm gear so that said thickness adjustment insert turns with said worm gear upon rotation of said worm.

7. The device of claim 6 wherein said thickness adjustment insert comprises a first thread and said thickness adjustment screw comprises a second thread meshed with said first thread and said thickness adjusting means comprises means for inhibiting rotation of said thickness adjustment screw so that upon rotation of said thickness adjustment insert, said thickness adjusting screw moves longitudinally with respect to said thickness adjusting insert.

8. The device of claim 7 wherein said one of said roller dies is supported on a first roller die shaft and said first roller die shaft is supported in a bearing block and said bearing block is connected to said thickness adjustment screw by connecting means so that said bearing block moves in said direction of travel and said thickness adjustment screw moves longitudinally.

9. The device of claim 8 said first and second threads having a pitch wherein the pitch in at least one of said stations is different from the pitch in at least one other of said stations.

10. The device of claim 8 wherein said roll forming machine comprises a base block and each of said stations is affixed to said base block, each said station further comprising $\alpha$ adjustment means for adjusting said direction of travel so that said station may be adjusted so that said direction of travel is directly related to said angle $\alpha$.

11. The device of claim 10 wherein said station includes a pivot bracket fixed with respect to said base block and said $\alpha$ adjustment means includes a gear housing, and an $\alpha$ thickness adjustment screw for pivoting said gear housing about said axis of said shaft, and wherein said gear housing is movably supported by said pivot bracket.

12. The device of claim 11 wherein said station comprises parallel means for adjustably locating said first roller die shaft with respect to said second roller die shaft so that the axes of said shafts are parallel and said levelling means may position said first roller die shaft without altering the relative location of said gear housing with respect to said pivot bracket.

13. The device of claim 12 wherein said worm gear and said thickness adjustment insert are contained within said gear housing.

14. The device of claim 13 wherein said connecting means connecting said thickness adjustment screw to said bearing block comprise an adjustment block and a levelling block.

15. The device of claim 14 wherein said levelling block is movably connected to said adjustment block for pivotal movement of said levelling block about said axis of said shaft without movement of said adjustment block.

16. The device of claim 11 wherein said α adjustment means further includes a first α adjustment shaft mounted to said pivot bracket and a second α adjustment shaft mounted to said gear housing and said α thickness adjustment screw is threadedly received within one of said first and second α adjustment shafts and rotatably, non-threadedly received in the other of said adjustment shafts.

17. The device of claim 15 wherein said parallel adjustment means comprises a parallel adjustment screw, a first levelling shaft mounted to said levelling block, a second levelling shaft mounted to said adjustment block and wherein said parallel adjustment screw is threadably received within one of said first and second levelling shafts and rotatably, non-threadably received in the other of said levelling shafts.

18. A roll forming machine, said roll forming machine comprising a plurality of stations for forming a flat metal strip into a product, each of said stations having a roller die set comprising a first roller die and a second roller die, said roller die set defining an angle α for bending said metal strip, each of said stations having a different angle α, thickness adjustment means for moving one of said roller dies of said roller die set relative to the other of said roller dies, in a direction of travel directly related to the angle α for adjusting said station to be able to form products from different thicknesses of said metal strip, said thickness adjustment means comprising a thickness adjustment insert and a thickness adjustment screw, and common operating means for operating said adjustment means of each of said stations simultaneously, said common operating means comprising a shaft having a longitudinal axis, said shaft being mounted in bearings for rotation about said axis, said shaft comprising a worm and each said station comprises a worm gear for meshing with said worm, said common operating means further comprising motor means for rotating said shaft.

19. A roll forming machine, said roll forming machine comprising a plurality of stations for forming a flat metal strip into a product, each of said stations having a roller die set comprising a first roller die and a second roller die, said roller die set defining a angle α for bending said metal strip, each of said stations having a different angle α, thickness adjustment means for moving one of said roller dies of said roller die set relative to the other of said roller dies, in a direction of travel directly related to the angle alpha for adjusting said station to be able to form products from different thicknesses of said metal strip, said thickness adjustment means comprising a thickness adjustment insert and a thickness adjustment screw, and common operating means for operating said adjustment means of each of said stations simultaneously.

* * * * *